US009470470B2

(12) United States Patent
Pisani et al.

(10) Patent No.: US 9,470,470 B2
(45) Date of Patent: Oct. 18, 2016

(54) SCOPE GUARD FOR SCOPE AND FIREARM

(71) Applicants: Marco Pisani, Woodbridge (CA); Andrea Nazzareno Pisani, Woodbridge (CA)

(72) Inventors: Marco Pisani, Woodbridge (CA); Andrea Nazzareno Pisani, Woodbridge (CA)

( * ) Notice: Subject to any disclaimer, the term of this patent is extended or adjusted under 35 U.S.C. 154(b) by 0 days.

(21) Appl. No.: 14/121,783

(22) Filed: Oct. 17, 2014

(65) Prior Publication Data

US 2015/0323278 A1 Nov. 12, 2015

Related U.S. Application Data

(60) Provisional application No. 61/892,212, filed on Oct. 17, 2013.

(51) Int. Cl.
*F41A 35/02* (2006.01)

(52) U.S. Cl.
CPC ..... *F41A 35/02* (2013.01)

(58) Field of Classification Search
CPC ..... F41G 1/04; F41G 1/065; F41G 1/383; F41A 35/02; F41C 27/04; F41H 5/12
USPC ..... 42/96, 129, 143; 89/36.06
See application file for complete search history.

(56) References Cited

U.S. PATENT DOCUMENTS 1,710,109 A * 4/1929 Paulus et al. ..... F41G 1/383 359/511
2,696,672 A * 12/1954 Durfee ..... F41G 1/383 359/511
2,782,510 A * 2/1957 Kramm ..... F41G 1/383 359/511
3,746,423 A * 7/1973 Mills ..... F41G 1/383 359/511
3,977,113 A * 8/1976 Howell ..... F41G 1/383 42/129
4,734,989 A * 4/1988 Sanders ..... F41G 1/04 42/137
4,734,990 A * 4/1988 Sanders ..... F41G 1/04 33/277
5,003,697 A * 4/1991 Hampton et al. ..... F41G 1/383 359/511
7,571,562 B2 * 8/2009 Sutherby ..... F41G 11/003 42/71.01
8,505,228 B2 * 8/2013 Cheng ..... F41C 27/00 42/111
2014/0026463 A1 1/2014 Park
2015/0052796 A1 * 2/2015 Baker et al. ..... F41C 27/00 42/96

* cited by examiner

*Primary Examiner* — Bret Hayes
(74) *Attorney, Agent, or Firm* — Fitch, Even, Tabin & Flannery LLP

(57) ABSTRACT

An apparatus is for a scope assembly having a front scope section and a back scope section, and a firearm including a mounting rail having a front rail section and a back rail section. The apparatus includes a front scope guard frame configured to guard, at least in part, the front scope section of the scope assembly. A back scope guard frame is configured to guard, at least in part, the back scope section of the scope assembly. The front scope guard frame and the back scope guard frame are selectively positionable and movable, independently of each other, relative to the mounting rail. The front scope guard frame and the back scope guard frame are configured to selectively affix, independently of each other, once the front scope guard frame and the back scope guard frame are positioned just so.

21 Claims, 37 Drawing Sheets

SCOPE GUARD FOR SCOPE AND FIREARM

CROSS-REFERENCE TO RELATED PATENT APPLICATION(S)

This application claims priority benefit of U.S. Provisional Application No. 61/892,212, filed Oct. 17, 2013, entitled GUARD AND/OR SLOTTED MOUNT DEVICE FOR A TELESCOPIC AND/OR OPTIC SIGHT MOUNTED ON A FIREARM, and which is incorporated herein by reference.

This application is related to and claims domestic priority benefits under 35 USC §119(e) from U.S. Provisional Patent Application Ser. No. 61/892,212, filed on Oct. 17, 2013, entitled GUARD AND/OR SLOTTED MOUNT DEVICE FOR A TELESCOPIC AND/OR OPTIC SIGHT MOUNTED ON A FIREARM, and the entire content of which is expressly and hereby incorporated hereinto by reference.

TECHNICAL FIELD

Some aspects generally relate to (and are not limited to) an apparatus for a scope assembly, a firearm having a gun barrel, and a mounting rail securely mountable to the gun barrel of the firearm.

BACKGROUND

A telescopic sight, commonly called a scope or a scope assembly, is a sighting device that may be based on an optical refracting telescope. The scope assembly is equipped with some form of graphic image pattern (a reticle) mounted in an optically appropriate position in an optical system to give an accurate aiming point (to a target). The scope assembly is used for accurate aiming of a firearm, particularly for rifles. The scope assembly may include technical features, such as a sight, an iron sight, a reflector (reflex) sight, and/or a laser sight, etc.

SUMMARY

It will be appreciated there exists a need to mitigate (at least in part) at least one problem associated with the scope assembly. After much study of the known systems and methods with experimentation, an understanding of the problem and its solution has been identified and is articulated as follows:

Few firearms come with built-in telescopic sights. Mounting the scope assembly to the firearm requires additional equipment. A typical scope mounting system consists of a scope base and scope rings. By picking the appropriate combination of scope base to fit the firearm and scope rings to fit the scope, a wide range of scopes may be mounted to most firearms. With the appropriate combination of adjustable scope bases and scope rings, it is also possible to mount several telescopic sights on the same gun to make the gun more versatile. However, it is important to take into consideration whether or not a gun is particularly hard to mount. If the scope assembly is or if a gun is intended for long-range shooting, it could be that the amount of vertical adjustment range is smaller than required. This can be solved with the help of a vertically canted base or canted rings. The problem with having a plurality of scope rings is the cost for manufacturing scope rings that are never deployed for mounting the scope assembly, or finding a scope ring that fits for a particular model or type of scope assembly. For instance, what is needed is a universal scope mount that facilitates mounting of a scope guard relative to the scope assembly once the scope assembly is mounted to the firearm (the scope assembly may be provided by a wide variety of manufacturers).

Guards (or "protectors") and/or mounts for telescopic and/or optic sights (or "scopes") for a firearm may be known in the prior art. Shortcomings of prior art guards and/or mounts may include constructions from soft and/or flexible materials, a failure to provide a rigid frame, and/or an insufficient ability to withstand physical impacts that, were a protective scope guard not employed, may result in damage to the scope assembly and/or knocking the scope assembly out of alignment. Moreover, prior art guards and/or mounts may not provide a rigid frame affixed to the slotted mounts and/or allow for a uniform horizontal adjustment of the protective scope guard to the length of the scope assembly. The scope assembly may be called a telescopic sight, an optic sight, and any equivalent thereof.

It may be an object according to an aspect of one embodiment to provide a protective scope guard for the scope assembly.

It may be an object according to an aspect of one embodiment to provide a protective scope guard for the scope assembly having a rigid skeletal frame.

It may be an object according to an aspect of one embodiment to provide a protective scope guard that acts as a barrier to the scope assembly.

It may be an object according to an aspect of one embodiment to provide a protective scope guard for the scope assembly, with the protective scope guard affixed to a slotted mount by inner arm extensions.

It may be an object according to an aspect of one embodiment to provide a mount for securing the scope assembly on a firearm.

It may be an object according to an aspect of one embodiment to provide a mount for releasably securing a telescopic and/or scope assembly on a firearm.

It may be an object according to an aspect of one embodiment to provide a slotted mount for use with a protective scope guard for the scope assembly.

It may be an object according to an aspect of one embodiment to provide a slotted mount for a scope assembly on a firearm, and for a protective scope guard that is selectively adjustable relative to the scope assembly.

It may be an object according to an aspect of one embodiment to provide a slotted mount for a protective scope guard that is adapted for ready uniform horizontal adjustment relative to the length of the scope assembly on a firearm.

It may be an object according to an aspect of one embodiment to selectively cover and protect the top and sides of a center portion of the scope assembly, where elevation, parallax, and/or windage adjustments of the scope assembly may be located.

It may be an object according to an aspect of one embodiment to provide an outer guard cover configured to cover the top and sides of one end portion of the scope assembly, preferably without obstructing the use of an illumination adjuster of the scope assembly while in use.

It may be an object of the embodiment to obviate and/or mitigate one or more disadvantages, limitations, shortcomings and/or problems associated with the prior art, and/or to achieve one or more of the aforementioned objections of the embodiment.

According to the present embodiment, there is disclosed a protective scope guard (also called a scope guard) for the scope assembly (also called a scope, a telescopic scope, an optic scope, a telescopic sight, an optic sight, and any equivalent thereof). According to an aspect of one preferred embodiment, the protective scope guard may preferably have (but not necessarily) a rigid skeletal frame. The protective scope guard may provide a protective bather for the scope assembly.

According to the present embodiment, there is also disclosed a mount for securing the scope assembly on a firearm. The mount may preferably (but not necessarily) releasably secure the scope assembly on the firearm.

According to an aspect of one preferred embodiment, the mount may preferably (but not necessarily) be a slotted mount for the protective scope guard of the scope assembly. The protective scope guard may preferably (but not necessarily) be affixed to the slotted mount by inner arm extensions.

According to an aspect of one preferred embodiment, the slotted mount may preferably (but not necessarily) be both for the scope assembly positioned on (mounted to) the firearm, and for the protective scope guard. The protective scope guard may preferably be (but not necessarily) selectively adjustable relative to the scope assembly. The slotted mounts may preferably be (but not necessarily) adapted for ready uniform horizontal adjustment of the protective scope guard relative to the length of the scope assembly on the firearm.

According to an aspect of one preferred embodiment, the protective scope guard may preferably (but not necessarily) avoid, help to avoid and/or lessen the chances and/or the severity of possible damage to the scope assembly. The scope assembly is also called a telescopic, an optic sight, etc. the protective scope guard may preferably (but not necessarily) avoid knocking the scope assembly out of alignment with the firearm, as may frequently occur when no protective scope guard (or protector) is employed.

In use, the mounts may preferably be (but not necessarily) shaped to define slots which are adapted to securely receive the inner arm extensions, one each, on either side of the protective scope guard. The inner arm extensions and/or the slots may preferably be (but not necessarily) provided with and/or shaped to define the mount connecting members (also called connecting members) to firmly secure the protective scope guard to the slotted mount and/or relative to the scope assembly and/or the firearm. The mount connecting members may preferably (but not necessarily) releasably secure the protective scope guard to the mount and/or relative to the scope assembly and/or firearm. The mount connecting members may preferably (but not necessarily) readily provide for uniform horizontal adjustment of the protective scope guard to accommodate and/or correspond with a plurality of telescopic and/or optic sights of various lengths.

According to the present embodiment, there is also disclosed a guard section (also called a hinged guard section) which may be selectively moved between a closed configuration and an opened configuration. In the opened configuration, a guard cover portion may preferably be raised or elevated out from between the front mounts and the rear mounts. In the closed configuration, (A) the guard cover portion may preferably be interposed between the front mounts and the rear mounts, and (B) the guard cover portion covers the top and sides of a center portion of the scope assembly, where elevation, parallax adjustments, and/or windage adjustments of the scope assembly may be located. Preferably, the guard section may selectively expose (in the opened configuration) and protect (in the closed configuration) the elevation, parallax adjustment and/or windage adjustments of the scope assembly.

According to the present embodiment, there is also disclosed an outer guard cover which preferably covers the top and sides of one end portion of the scope assembly. Two instances of the outer guard cover, positioned at opposite ends of the scope assembly, may preferably protect the scope assembly from possible damage and knocking same out of alignment, preferably without obstructing the use of an illumination adjuster of the scope assembly while the outer guard cover is in use.

Other advantages, features and characteristics of the present embodiments, as well as methods of operation and functions of related elements of the protective scope guard and/or slotted mount, and the combination of parts and economies of manufacture, will become apparent upon consideration of the following detailed description, and the claims of any applications which may claim priority herefrom, with reference to the accompanying figures, the latter of which are briefly described hereinbelow.

To mitigate, at least in part, at least one problem associated with existing scope guards, there is provided (in accordance with a major aspect) an apparatus. The apparatus is for a scope assembly, a firearm having a gun barrel, and a mounting rail securely mountable to the gun barrel of the firearm. The apparatus includes a mount configured to selectively releasably securely affix to the mounting rail of the firearm in such a way that the mounting rail provides stable positioning of the mount once the mount is affixed to the mounting rail. The apparatus also includes a rigid protective scope guard frame configured to selectively securely affix to the mount. The rigid protective scope guard frame is also configured to surround, at least in part, the scope assembly once the rigid protective scope guard frame is affixed to the mount. The rigid protective scope guard frame is also configured to allow normal usage of the scope assembly once the rigid protective scope guard frame is affixed to the mount.

To mitigate, at least in part, at least one problem associated with existing scope guards, there is provided (in accordance with a major aspect) an apparatus. The apparatus includes a scope assembly, a firearm having a gun barrel, and a mounting rail securely mountable to the gun barrel of the firearm. The apparatus also includes a mount configured to selectively releasably securely affix to the mounting rail of the firearm in such a way that the mounting rail provides stable positioning of the mount once the mount is affixed to the mounting rail. The apparatus also includes a rigid protective scope guard frame configured to selectively securely affix to the mount. The rigid protective scope guard frame is also configured to surround, at least in part, the scope assembly once the rigid protective scope guard frame is affixed to the mount. The rigid protective scope guard frame is also configured to allow normal usage of the scope assembly once the rigid protective scope guard frame is affixed to the mount.

To mitigate, at least in part, at least one problem associated with existing scope guards, there is provided (in accordance with a major aspect) an apparatus. The apparatus is for a scope assembly, a firearm having a gun barrel, and a mounting rail securely mountable to the gun barrel of the firearm. The apparatus includes a front mount configured to selectively releasably securely affix to a front rail section of the mounting rail of the firearm in such a way that the mounting rail provides stable positioning of the front mount. The apparatus also includes a rear mount configured to selectively releasably securely affix to a rear section of the mounting rail of the firearm in such a way that the mounting rail provides stable positioning of the rear mount. The apparatus also includes a rigid protective front scope guard frame configured to selectively securely affix to the front mount, and the rigid protective front scope guard frame is also configured to surround, at least in part, a front scope section (front scope portion) of the scope assembly once the rigid protective front scope guard frame is affixed to the front mount, and the rigid protective front scope guard frame is also configured to allow normal usage of the scope assembly once the rigid protective front scope guard frame is affixed to the front mount. The apparatus also includes a rigid protective rear scope guard frame configured to selectively securely affix to the rear mount, and the rigid protective rear scope guard frame is also configured to surround, at least, in part, a rear portion of the scope assembly once the rigid protective front scope guard frame is affixed to the front mount; and the rigid protective rear scope guard frame is also configured to allow normal usage of the scope assembly once the rigid protective rear scope guard frame is affixed to the rear mount.

In accordance with a general embodiment, an apparatus is provided for a scope assembly having a front scope section and a back scope section, and a firearm including a mounting rail having a front rail section and a back rail section. The apparatus includes (and is not limited to): (A) a mount being configured to selectively affix the mounting rail to the scope assembly; (B) a front scope guard frame being configured to guard, at least in part, the front scope section of the scope assembly; (C) a back scope guard frame being configured to guard, at least in part, the back scope section of the scope assembly; (D) the front scope guard frame and the back scope guard frame being selectively positionable and movable, independently of each other, relative to the mount; and (E) the front scope guard frame and the back scope guard frame being configured to selectively affix, independently of each other, to the mount once the front scope guard frame and the back scope guard frame are positioned just so.

In accordance with a general embodiment, an apparatus is provided for a scope assembly having a front scope section and a back scope section, and a firearm including a mounting rail having a front rail section and a back rail section. The apparatus includes (and is not limited to) a front scope guard frame configured to be affixed at a front stationary position relative to the mounting rail of the firearm. The front scope guard frame is also configured to guard, at least in part, the front scope section of the scope assembly. The apparatus also includes a back scope guard frame configured to be affixed at a back stationary position relative to the mounting rail of the firearm. The back scope guard frame is also configured to guard, at least in part, the back scope section of the scope assembly. The front scope guard frame and the back scope guard frame are selectively positionable and movable, independently of each other at the front stationary position and the back stationary position, respectively. The front scope guard frame and the back scope guard frame are configured to be selectively affixed, independently of each other, at the front stationary position and the back stationary position, respectively, relative to the mounting rail of the firearm once the front scope guard frame and the back scope guard frame are positioned just so.

In accordance with a general embodiment, an apparatus is provided. The apparatus includes (and is not limited to) a scope assembly having a front scope section and a back scope section. The apparatus also includes a firearm including a mounting rail having a front rail section and a back rail section. The apparatus also includes a front scope guard frame configured to be affixed at a front stationary position relative to the mounting rail of the firearm, and also configured to guard, at least in part, the front scope section of the scope assembly. The apparatus also includes a back scope guard frame configured to be affixed at a back stationary position relative to the mounting rail of the firearm, and also configured to guard, at least in part, the back scope section of the scope assembly. The front scope guard frame and the back scope guard frame are selectively positionable and movable, independently of each other at the front stationary position and the back stationary position, respectively. The front scope guard frame and the back scope guard frame are configured to be selectively affixed, independently of each other, at the front stationary position and the back stationary position, respectively, relative to the mounting rail of the firearm once the front scope guard frame and the back scope guard frame are positioned just so.

Other aspects are identified in the claims.

Other aspects and features of the non-limiting embodiments may now become apparent to those skilled in the art upon review of the following detailed description of the non-limiting embodiments with the accompanying drawings.

BRIEF DESCRIPTION OF DRAWINGS

The non-limiting embodiments may be more fully appreciated by reference to the following detailed description of the non-limiting embodiments when taken in conjunction with the accompanying drawings. The features as to the structure, organization, usage, and operation, together with further objectives and advantages thereof, will be better understood from the following figures in which embodiments will now be illustrated and/or depicted by way of example. It is expressly understood, however, that the figures are for the purpose of illustration, depiction, and/or description only, and are not intended as a definition of the limits of the embodiments. In the accompanying figures.

Figure 1:
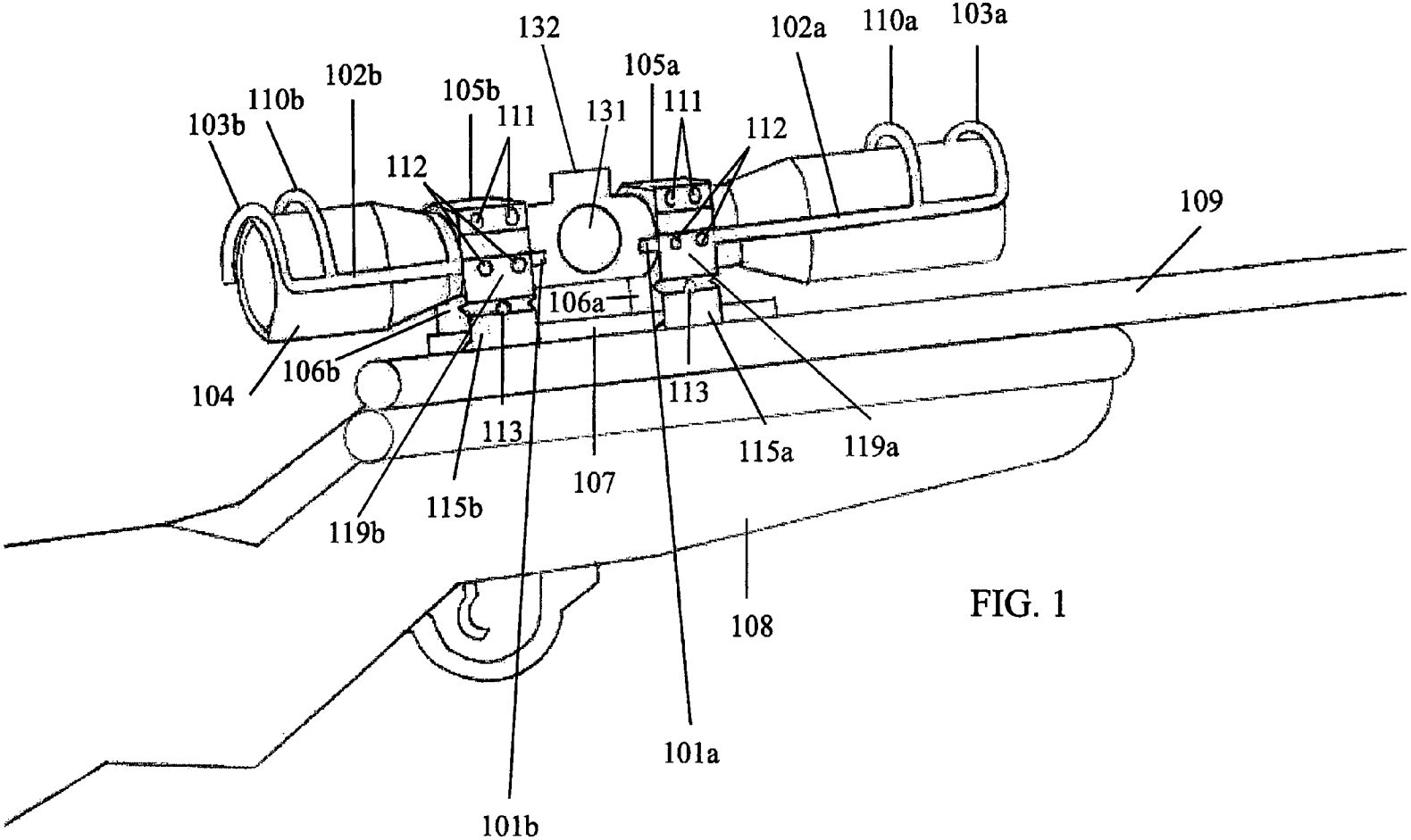
FIG. 1 depicts a top rear right perspective view of an embodiment of rigid protective front scope guard frames and rigid protective rear scope guard frames, and the slotted mounts shown in use, mounted to a firearm with a scope assembly mounted to the firearm.
Figure 2:
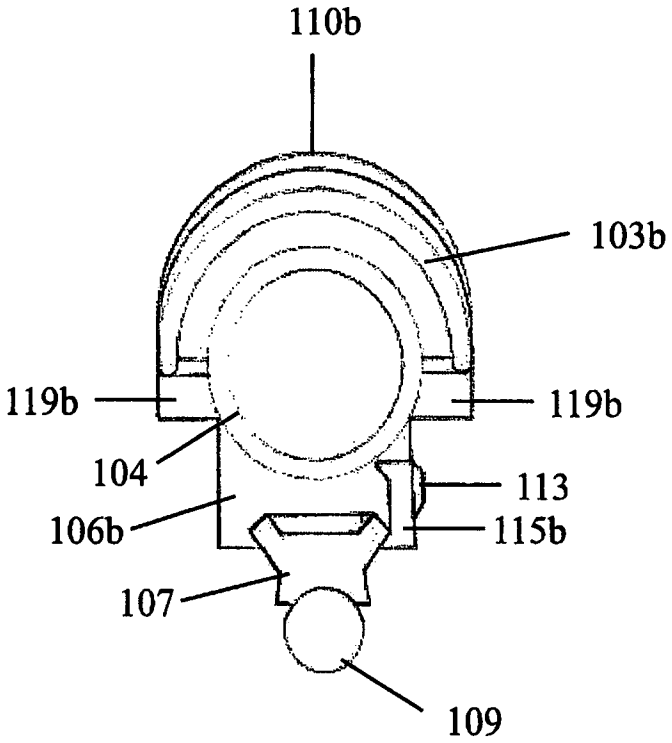
FIG. 2 depicts an enlarged rear elevational view of an embodiment of the rigid protective rear scope guard frames and the slotted mounts of the scope assembly of FIG. 1.
Figure 3:
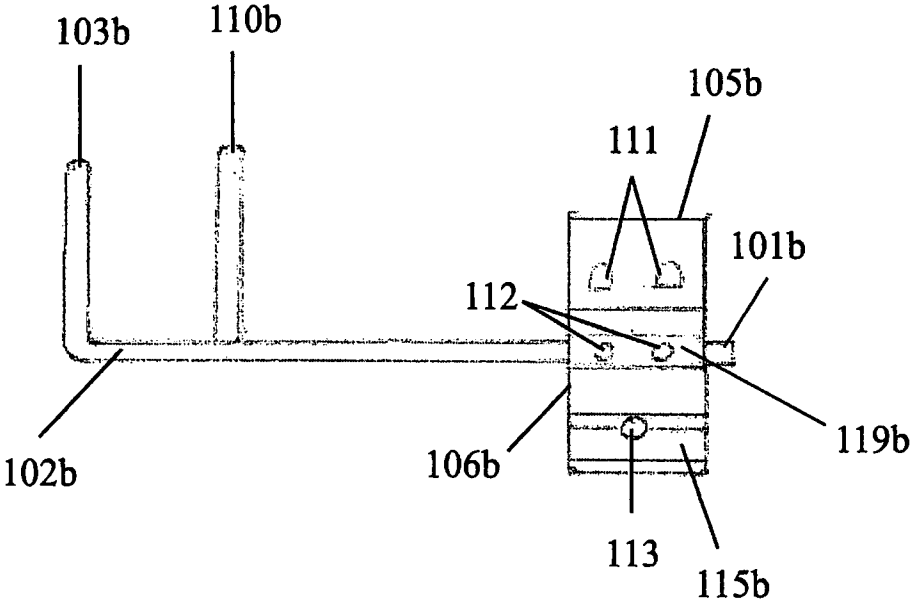
FIG. 3 depicts a right side elevational view of an embodiment of the rigid protective rear scope guard frames and the rear slotted mounts of FIG. 1.
Figure 4:
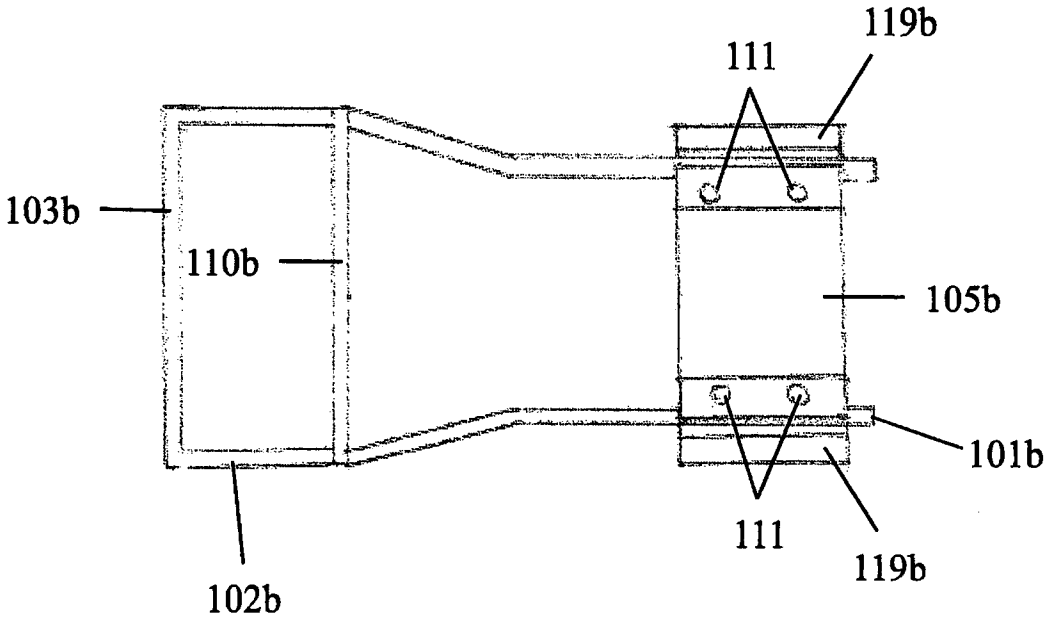
FIG. 4 depicts a top plan view of an embodiment of the rigid protective rear scope guard frames and the rear slotted mount of FIG. 1.
Figure 5:
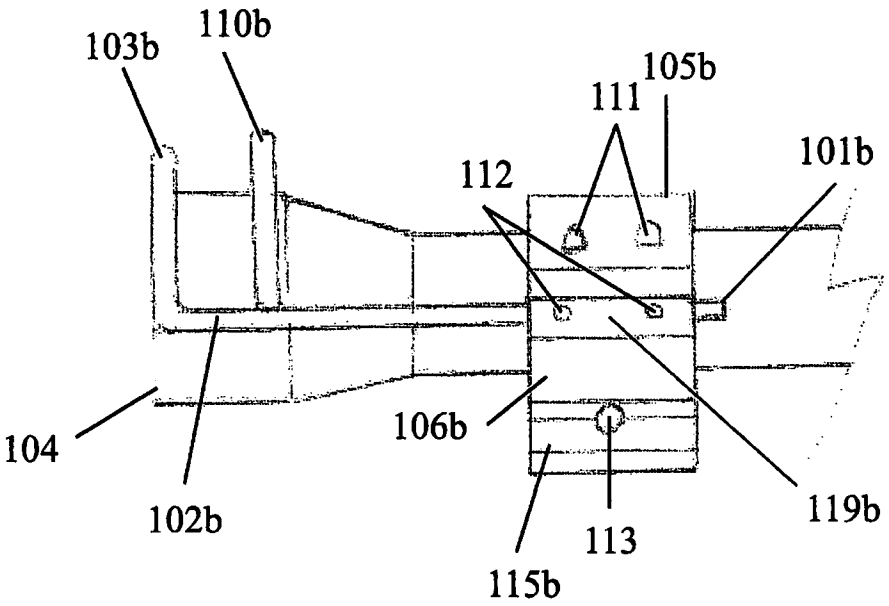
FIG. 5 depicts a right side elevational view of an embodiment of the rigid protective rear scope guard frames and the rear slotted mounts of FIG. 3, shown in use with the scope assembly.
Figure 6:
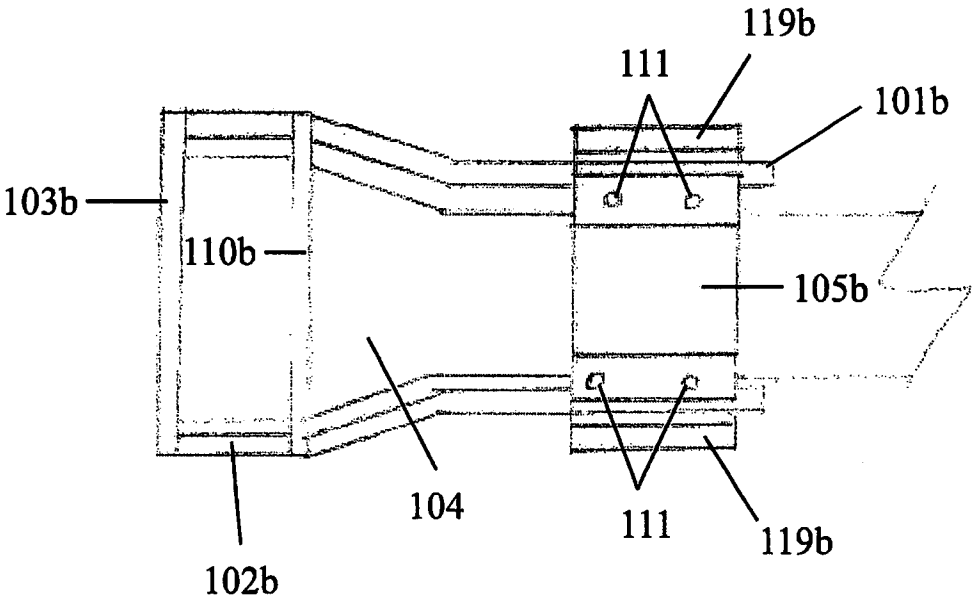
FIG. 6 depicts a top plan view of an embodiment of the rigid protective rear scope guard frames, and the slotted mount and the scope assembly of FIG. 5.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the Drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

101*a* front inner arm extension
101*b* back inner arm extension
102*a* front side scope guard frame
102*b* back side scope guard frame
103*a* first front top scope guard frame
103*b* first back top scope guard frame
104 scope assembly
105*a* front top clamp
105*b* back top clamp
106*a* front bottom slotted mount
106*b* back bottom slotted mount
107 mounting rail
108 firearm

109 gun barrel
110*a* second front top scope guard frame
110*b* second back top scope guard frame
111 scope mounting fasteners
112 inner mounting arm extension fastener
113 rail clamp mount fastener
114 inner arm connecting member
115*a* front mount rail clamp
115*b* back mount rail clamp
117 inner arm extension slot
118*a* front scope cradle
119*a* front side protruding scope guard arm
119*b* back side protruding scope guard arm
126 guard cover portion
127 rod extension
128 resilient latch extension
129 hinge member
130 guard section
131 elevation adjustment
132 parallax and windage adjustments
133 hinge rod
134 outer guard
135 power ring zoom adjuster

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the invention is defined by the claims. For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments, and any equivalent thereof) are described regarding the drawings. It should be understood that the invention is limited to the subject matter provided by the claims, and that the invention is not limited to the particular aspects depicted and described.

Referring to the figures in detail, wherein like numerals designate like parts, and referring first to FIGS. 1 to 7 there is shown a preferred scope assembly 104. The scope assembly 104 may also be called a telescopic sight, an optic sight, a telescopic scope, an optic scope, and any equivalent thereof, and a protective scope guard according to a preferred embodiment. In accordance with an embodiment, the protective scope guard includes: (A) a front side scope guard frame 102*a*, (B) a first front top scope guard frame 103*a*, (C) a second front top scope guard frame 110*a* secured by a front top clamp 105*a* (also called a front slotted mount), (D) a front bottom slotted mount 106*a*, (D) a front mount rail clamp 115*a* (also called a front slotted mount), (E) a back side scope guard frame 102*b*, (F) a first back top scope guard frame 103*b*, and (G) a second back top scope guard frame 110*b* secured by a back top clamp 105*b*, a back bottom slotted mount 106*b* and a back mount rail clamp 115*b*.

Figure 8:
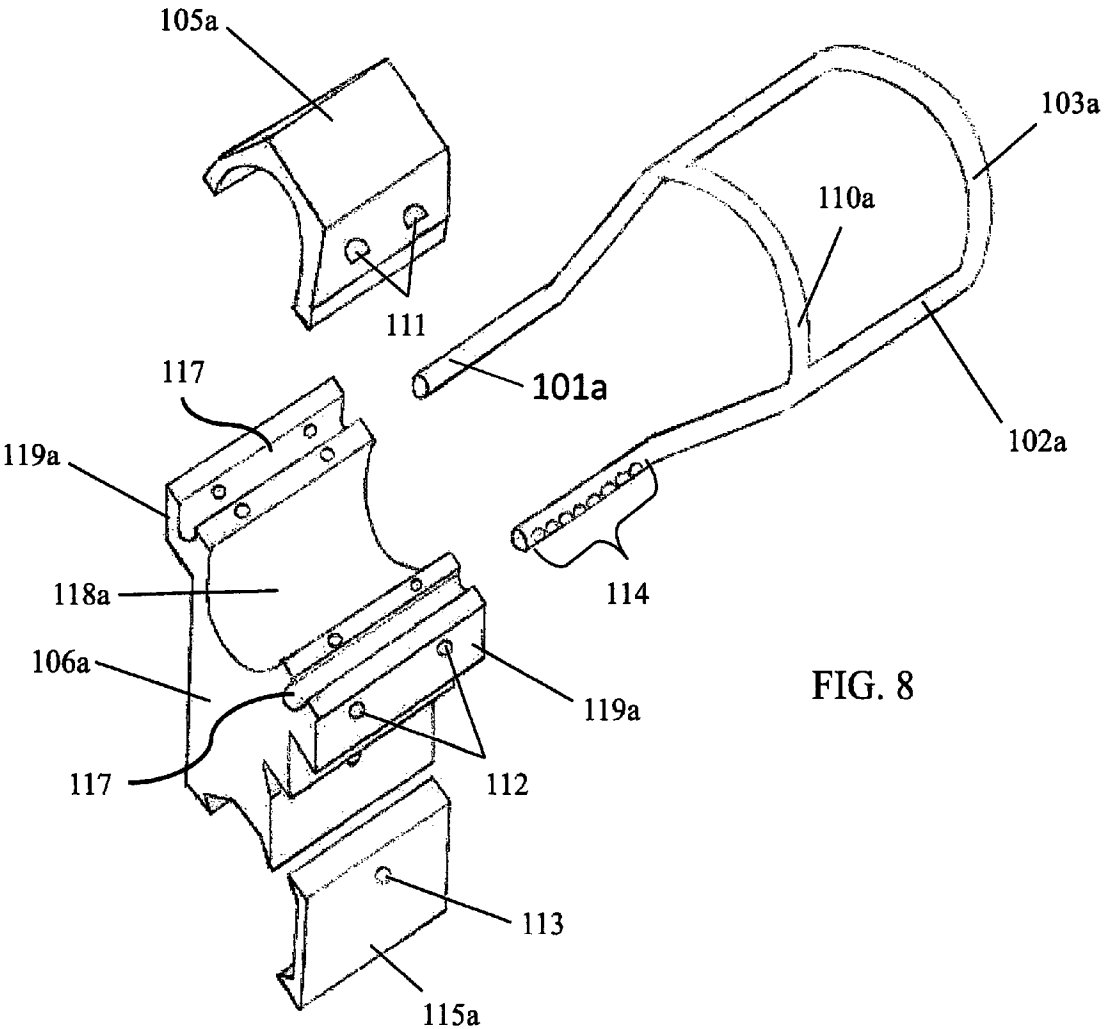
FIG. 8 depicts an exploded top rear right perspective view of an embodiment of the front scope guard frame and slotted mount of FIG. 1.

Referring to FIG. 1 and FIG. 8, the front inner arm extension 101*a* extends from the front side scope guard frame 102*a*. The front inner arm extension 101*a* is configured to interface with the front side protruding scope guard arm 119*a*. As depicted, the front inner arm extension 101*a* is configured to be operatively received along the inner arm extension slot 117 defined by the front side protruding scope guard arm 119*a*. The front side protruding scope guard arm 119*a* is provided by the front bottom slotted mount 106*a*.

Referring to FIG. 1 and FIG. 8, the back inner arm extension 101*b* extends from the back side scope guard frame 102*b*. The back inner arm extension 101*b* is configured to interface with the back side protruding scope guard arm 119*b*. As depicted, the back inner arm extension 101*b* is configured to be operatively received along the inner arm extension slot 117 defined by the back side protruding scope guard arm 119*b*. The back side protruding scope guard arm 119*b* is provided by the back bottom slotted mount 106*b*.

In accordance with a preferred embodiment, the rigid protective front scope guard frame (also called the scope guard frame) includes the combination of the front side scope guard frame 102*a*, the first front top scope guard frame 103*a*, and the second front top scope guard frame 110*a*. The rigid protective rear scope guard frame (also called the scope guard frames) includes the combination of the back side scope guard frame 102*b*, the first back top scope guard frame 103*b*, and the second back top scope guard frame 110*b*. The rigid protective front scope guard frame and the rigid protective rear scope guard frame are each configured to: (A) be mounted to the scope assembly 104 independently of each other, and (B) be adjustably positioned and mounted to the scope assembly 104 (to accommodate for the geometry of the scope assembly 104). The technical effect of this arrangement is that the rigid protective front scope guard frame and the rigid protective rear scope guard frame are usable (mountable) to a relatively wider selection of different models and makes of the scope assembly 104. In this manner, the rigid protective front scope guard frame and the rigid protective rear scope guard frame is a universal frame for the scope assembly 104.

The mounts (slotted mounts) may be collectively and generally referenced herein by: the front top clamp 105*a*, the back top clamp 105*b*, the front bottom slotted mount 106*a*, the back bottom slotted mount 106*b*, the front mount rail clamp 115*a*, and the back mount rail clamp 115*b*, etc.

The back bottom slotted mount 106*b*, the back top clamp 105*b*, the back mount rail clamp 115*b*, the front bottom slotted mount 106*a*, the front top clamp 105*a*, and the front mount rail clamp 115*a* of the protective scope guard are preferably secured to the scope assembly 104 and to the mounting rail 107 of the firearm 108 (as depicted). The scope assembly 104 may be called a telescopic scope assembly, an optic sight assembly, and any equivalent thereof. For instance, the mounting rail 107 may include the Weaver rail mount, the Picatinny rail or tactical rail (and any equivalent thereof). The mounting rail 107 is a bracket configured to be affixed to the firearm 108. The mounting rail 107 is configured to provide a mounting platform for accessories and attachments.

Each of the front side scope guard frame 102*a*, the back side scope guard frame 102*b*, the first front top scope guard frame 103*a*, the first back top scope guard frame 103*b*, the second front top scope guard frame 110*a*, and the second back top scope guard frame 110*b* preferably has an outer body portion and an inner body portion. The front side scope guard frame 102*a*, the back side scope guard frame 102*b*, the first front top scope guard frame 103*a*, the first back top scope guard frame 103*b*, the second front top scope guard frame 110*a*, and the second back top scope guard frame 110*b* are preferably formed of grade number 304 stainless steel. Each of the outer body portion and the inner body portion is preferably a semi-cylindrical skeletal frame while in its normal use position. Distal end portions of the front side scope guard frame 102*a*, the back side scope guard frame 102*b*, the first front top scope guard frame 103*a*, the first back top scope guard frame 103*b*, the second front top scope guard frame 110*a*, and the second back top scope guard frame 110*b* are preferably open and unobstructed to allow normal usage of the scope assembly 104 while the protective scope guard is mounted on the firearm 108. As shown in the drawings, the protective scope guard may preferably be sufficiently long and wide to extend the entire length and width of the scope assembly 104 of the firearm 108 while held in a spaced relation from the scope assembly 104, as shown in FIGS. 1, 2, 5 and 6.

Two instances of a front side scope guard frame 102*a* extend from the first front top scope guard frame 103*a* toward the front bottom slotted mount 106*a*. The two instances of the front side scope guard frame 102*a* are aligned parallel to each other and are spaced apart from each other. The two instances of the front side scope guard frame 102*a* are configured to be connectable to and disconnectable from the front bottom slotted mount 106*a*. Two instances of a back side scope guard frame 102*b* extend from the first back top scope guard frame 103*b* toward the front bottom slotted mount 106*a*. The two instances of the back side scope guard frame 102*b* are aligned parallel to each other and are spaced apart from each other. The two instances of the back side scope guard frame 102*b* are configured to be connectable to and disconnectable from the back bottom slotted mount 106*b*. Each of the front side scope guard frame 102*a* and the back side scope guard frame 102*b* preferably extends between and towards, and securely engages, one end of the outer body portion, an adjacent corresponding end of the inner body portion, and a corresponding one of the front bottom slotted mount 106*a* and the back bottom slotted mount 106*b* that is adjacent to the inner body portion. As may be best seen in FIGS. 7 to 8, an inner arm connecting member 114 is preferably provided along an end portion of each of the front side scope guard frame 102*a* and the back side scope guard frame 102*b*, which is proximal to the front top clamp 105*a*, the back top clamp 105*b*, the front bottom slotted mount 106*a*, the back bottom slotted mount 106*b*, the front mount rail clamp 115*a* and the back mount rail clamp 115*b*. The inner arm connecting member 114 may preferably be provided as divots (also called a cavity or a set of cavities or grooves, etc.), other female connecting members or male connecting members, and/or other instances of the inner arm connecting member 114.

Each of the front top clamp 105*a*, the back top clamp 105*b*, the front bottom slotted mount 106*a*, the back bottom slotted mount 106*b*, the front mount rail clamp 115*a*, the back mount rail clamp 115*b* is preferably shaped to define an inner arm extension slot 117 (such as, two instances of the inner arm extension slot 117). The instances of the inner arm extension slot 117 are preferably adapted to securely receive the front side scope guard frame 102*a* and the back side scope guard frame 102*b*, one each, on either side of the scope assembly 104. The inner arm connecting member 114 is configured to firmly and releasably secure the front side scope guard frame 102*a*, the back side scope guard frame 102*b*, the first front top scope guard frame 103*a*, the first back top scope guard frame 103*b*, the second front top scope guard frame 110*a*, and the second back top scope guard frame 110*b* to the front top clamp 105*a*, the back top clamp 105*b*, the front bottom slotted mount 106*a*, the back bottom slotted mount 106*b*, the front mount rail clamp 115*a*, the back mount rail clamp 115*b* (and relative to the scope assembly 104 and the firearm 108). The inner arm connecting member 114 is also configured to provide for uniform horizontal adjustment of the front side scope guard frame 102*a*, the back side scope guard frame 102*b*, the first front top scope guard frame 103*a* the first back top scope guard frame 103*b*, the second front top scope guard frame 110*a*, and the second back top scope guard frame 110*b* to accommodate and correspond with a plurality of scope assembly 104 of various lengths. The inner arm connecting member 114 of the front side scope guard frame 102*a*, the back side scope guard frame 102*b*, the first front top scope guard frame 103*a*, the first back top scope guard frame 103*b*, the second front top scope guard frame 110*a*, and the second back top scope guard frame 110*b* may preferably be firmly and releasably secured to the front top clamp 105*a*, the back top clamp 105*b*, the front bottom slotted mount 106*a*, the back bottom slotted mount 106*b*, the front mount rail clamp 115*a* and the back mount rail clamp 115*b* by way of an inner mounting arm extension fastener 112 (such as, two instances of the inner mounting arm extension fastener 112). Each inner mounting arm extension fastener 112 may preferably be provided as a mating connecting member, and/or adapted to receive a pin in registered relation along with one of the inner arm connecting members 114.

The front side scope guard frame 102*a*, the first front top scope guard frame 103*a* and the second front top scope guard frame 110*a*, and the back side scope guard frame 102*b*, the first back top scope guard frame 103*b* and the second back top scope guard frame 110*b* are thus received and firmly secured by a respective one of the front and rear slotted mounts 105*a*, the back top clamp 105*b*, the front bottom slotted mount 106*a*, the back bottom slotted mount 106*b*, the front mount rail clamp 115*a* and the back mount rail clamp 115*b*. The front side scope guard frame 102*a*, the back side scope guard frame 102*b*, the first front top scope guard frame 103*a*, the first back top scope guard frame 103*b*, the second front top scope guard frame 110*a* and the second back top scope guard frame 110*b* face in opposite directions longitudinally along the firearm 108.

Each of the slotted mounts 105*a*, the back top clamp 105*b*, the front bottom slotted mount 106*a*, the back bottom slotted mount 106*b*, the front mount rail clamp 115*a* and the back mount rail clamp 115*b* preferably has a top mount portion, a base mount portion and a clamp portion. As may be appreciated from FIGS. 1, 2 and 8, each base mount portion may preferably be affixed to the mounting rail 107 of the firearm 108 by the clamp portion. The clamp portion is preferably secured to the base mount portions by a rail clamp mount fastener 113. The mounting rail 107 is preferably secured to the gun barrel 109 of the firearm 108 to provide for the stable positioning of the protective scope guard.

Referring to FIG. 8, each base mount portion is preferably shaped to define a scope tube cradle 118. The scope assembly 104 is preferably received by the scope cradle (such as, the front scope cradle 118*a* depicted in FIG. 8 and FIG. 9 and FIG. 10) of each of the base mount portions. As shown in FIGS. 1, 3, 4, 5, 6 and 8, the scope assembly 104, once received by the scope tube cradle 118 of each of the base mount portions, is secured in place by a respective top mount portion. As may be appreciated from FIG. 8, the base mount portion is preferably shaped to define apertures (e.g., threaded apertures) to receive scope mounting fasteners 111 to secure the top mount portion thereto.

As shown in FIGS. 1 to 7 (where the protective scope guard is shown fully secured to the firearm 108), the front side scope guard frame 102*a* and the back side scope guard frame 102*b* of the protective scope guard preferably extend the length of the scope assembly 104. The outer body portion and the inner body portion, at opposite ends of the scope assembly 104, are preferably contoured to the shape of the scope assembly 104, and preferably define a semi-cylindrical skeletal frame as previously mentioned. The front side scope guard frame 102*a*, the back side scope guard frame 102*b*, the first front top scope guard frame 103*a*, the first back top scope guard frame 103*b*, the second front top scope guard frame 110*a* and the second back top scope guard frame 110*b* and the outer body portion and the inner body portion of are each on its own, and all together, of a rigid construction. The front side scope guard frame 102*a*, the back side scope guard frame 102*b*, the first front top scope guard frame 103*a*, the first back top scope guard frame 103*b*, the second front top scope guard frame 110*a* and the second back top scope guard frame 110*b* are spaced from the scope assembly 104 sufficiently to avoid contact therewith, to act as a shield, and to protect the scope assembly 104 from direct contact with objects which might otherwise be likely to damage or knock the scope assembly 104 out of alignment.

Figure 7:
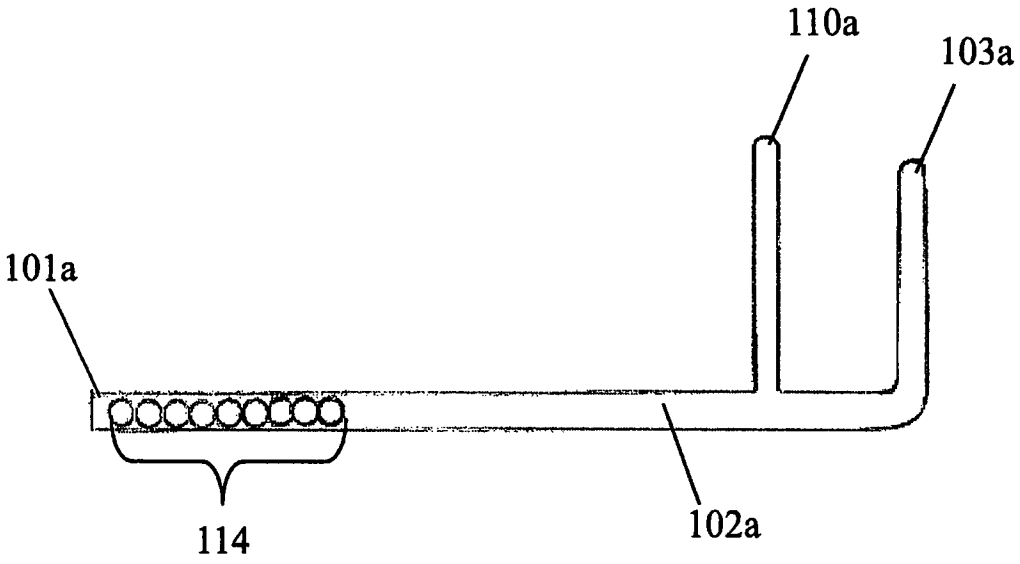
FIG. 7 depicts a right side elevational view of an embodiment of the front scope guard frame of FIG. 1.
Figure 9:
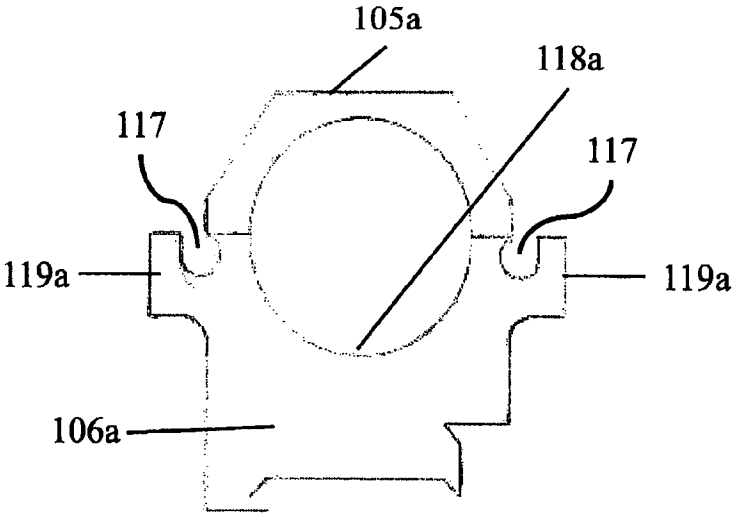
FIG. 9 depicts a rear view of an embodiment of a top mount portion and a base mount portion of the front slotted mounts of FIG. 1.
Figure 10:
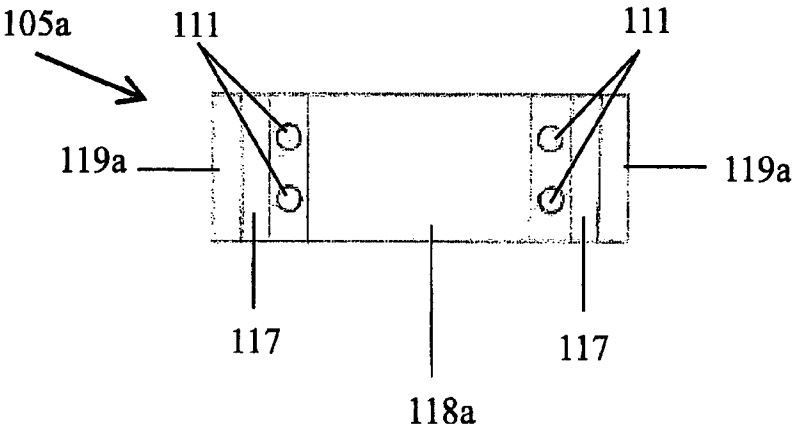
FIG. 10 depicts a top plan view of an embodiment of the top mount portion of FIG. 9.

Referring to FIGS. 8, 9 and 10, it may be appreciated that each base mount portion is preferably provided with the front side protruding scope guard arm 119*a* and the back side protruding scope guard arm 119*b*, each of which is preferably shaped to define a respective instance of the inner arm extension slot 117 to receive the front side scope guard frame 102*a* and the back side scope guard frame 102*b*. Each of the base mount portions (front and rear) preferably receives the front side scope guard frame 102*a* and the back side scope guard frame 102*b* extending from a respective one of the first front top scope guard frame 103*a* and the first back top scope guard frame 103*b*. As shown in FIGS. 7 and 8, the proximal end portion of each of the front side scope guard frame 102*a* and the back side scope guard frame 102*b* is provided with an inner arm connecting member 114. The inner arm connecting member 114 is for securing the front side scope guard frame 102*a* and the back side scope guard frame 102*b* to the base mount portions, and to allow for uniform horizontal extension and retraction of the front side scope guard frame 102*a* and the back side scope guard frame 102*b* relative to the base mount portions, depending on the length of the scope assembly 104. The inner arm connecting member 114 may include divots and any equivalent thereof.

The protective scope guard, while sturdy, preferably does not add greatly to the weight of the rifle or other instance of the firearm 108. Preferably, the protective scope guard is capable of protecting (at least in part) the scope assembly 104 from direct contact with objects that might otherwise likely damage or knock the scope assembly 104 out of alignment. While number 304 stainless steel is a preferred material for use in making the protective scope guard, other suitable materials could be employed, such as certain spring steels, mild steels, composites and fracture-resistant resins (and any equivalent thereof).

Figure 11:
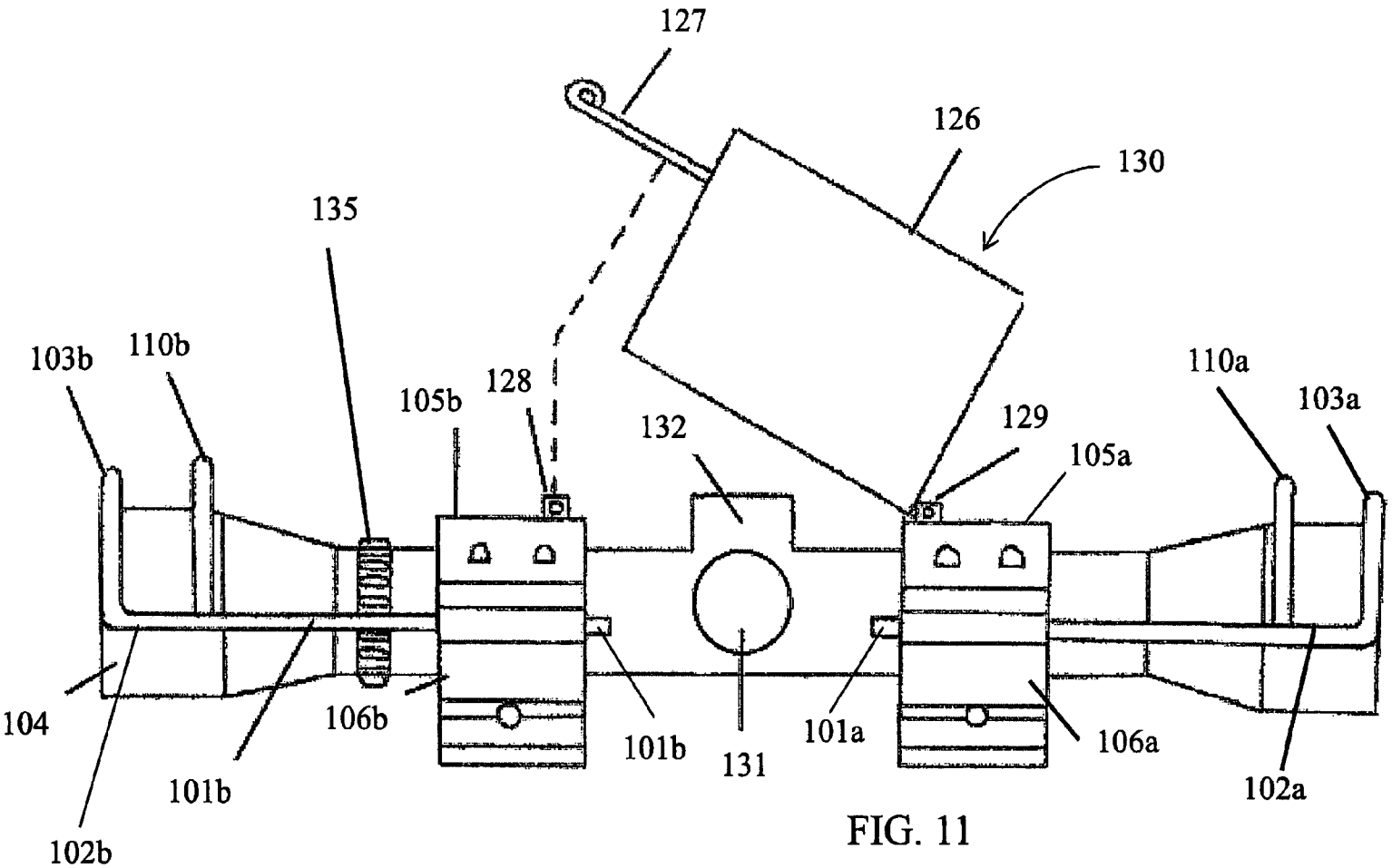
FIG. 11 depicts a right side elevational view of an embodiment of the front scope guard frame and the rigid protective rear scope guard frame, and the slotted mounts, shown with a guard section in an opened configuration, shown in use with the scope assembly of FIG. 1.
Figure 12:
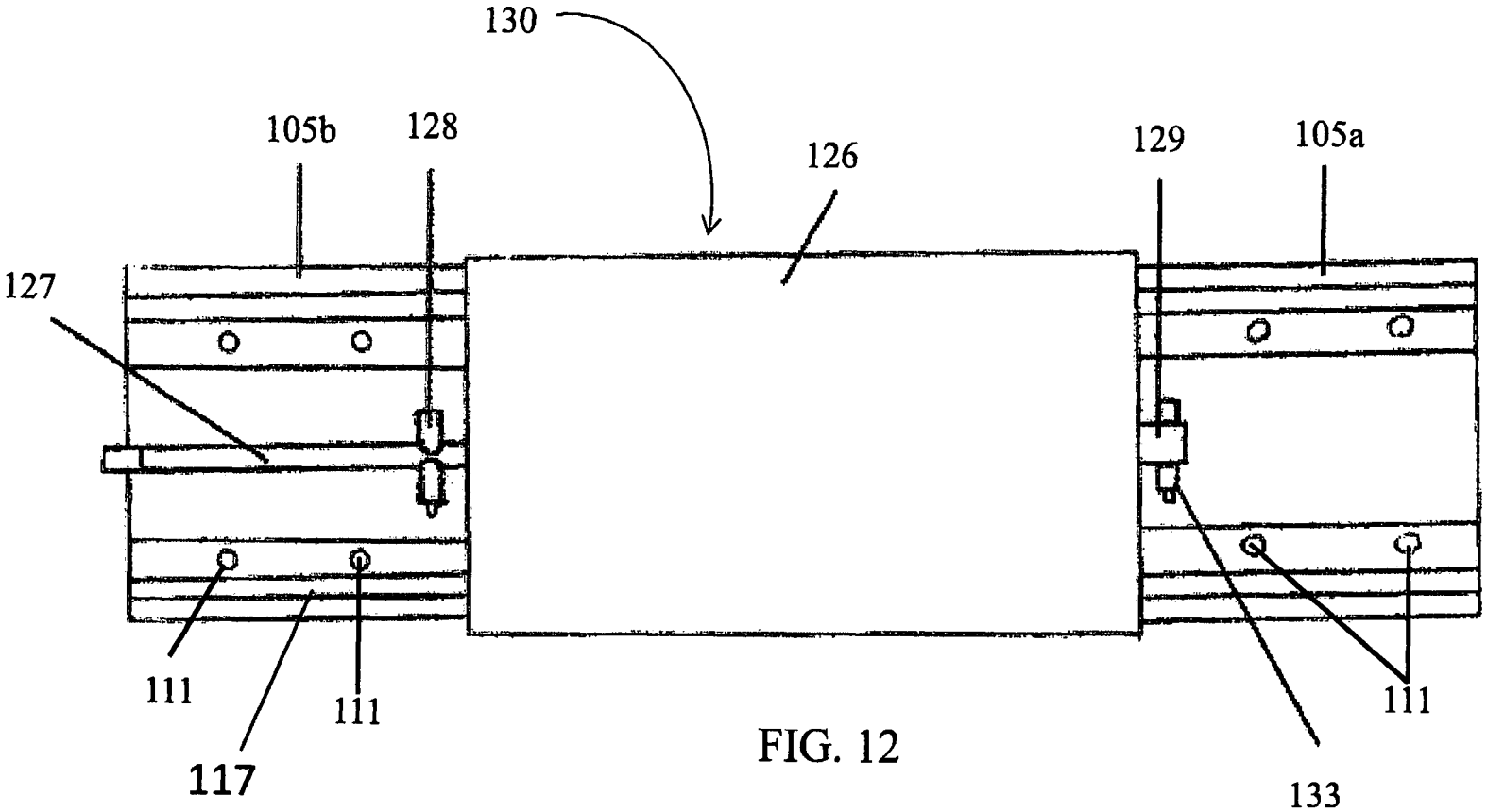
FIG. 12 depicts a top plan view of an embodiment of the front slotted mount and the rear slotted mount, and the guard section of FIG. 11, shown with the guard section in an interposed configuration.
Figure 13:
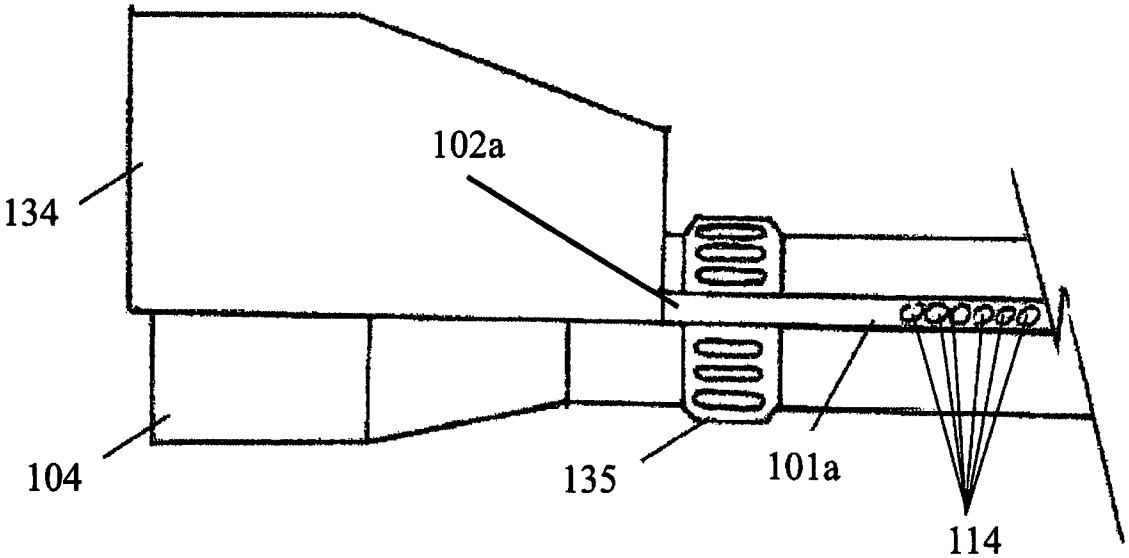
FIG. 13 depicts a right side elevational view of an embodiment of an outer guard cover shown in use with the rear portion of the scope assembly of FIG. 1.
Figure 14:
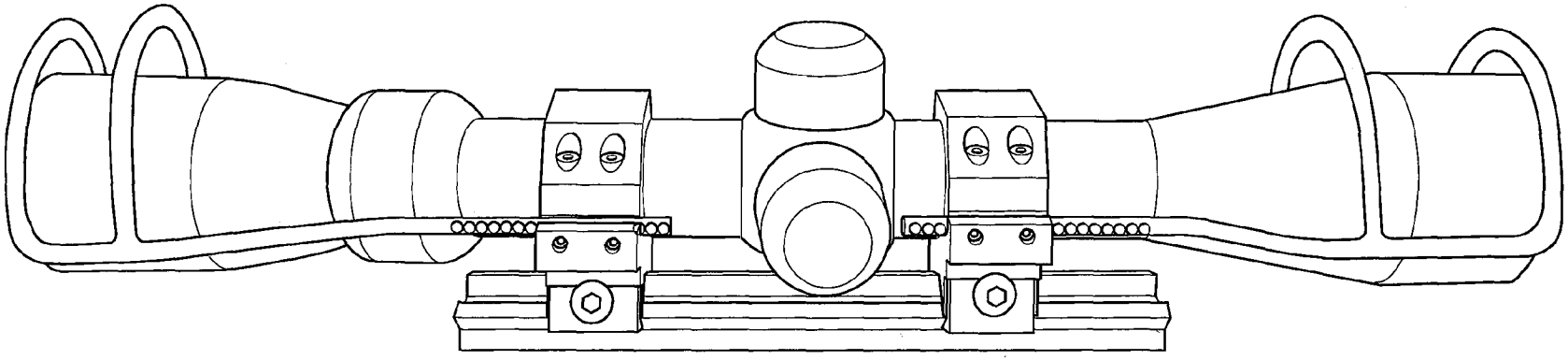
FIG. 14 depicts a top right perspective view of an embodiment of the front sight guard frame and the rear sight guard frames, and the slotted mounts of FIG. 1, shown in use with the scope assembly and a firearm track mounting portion.
Figure 15:
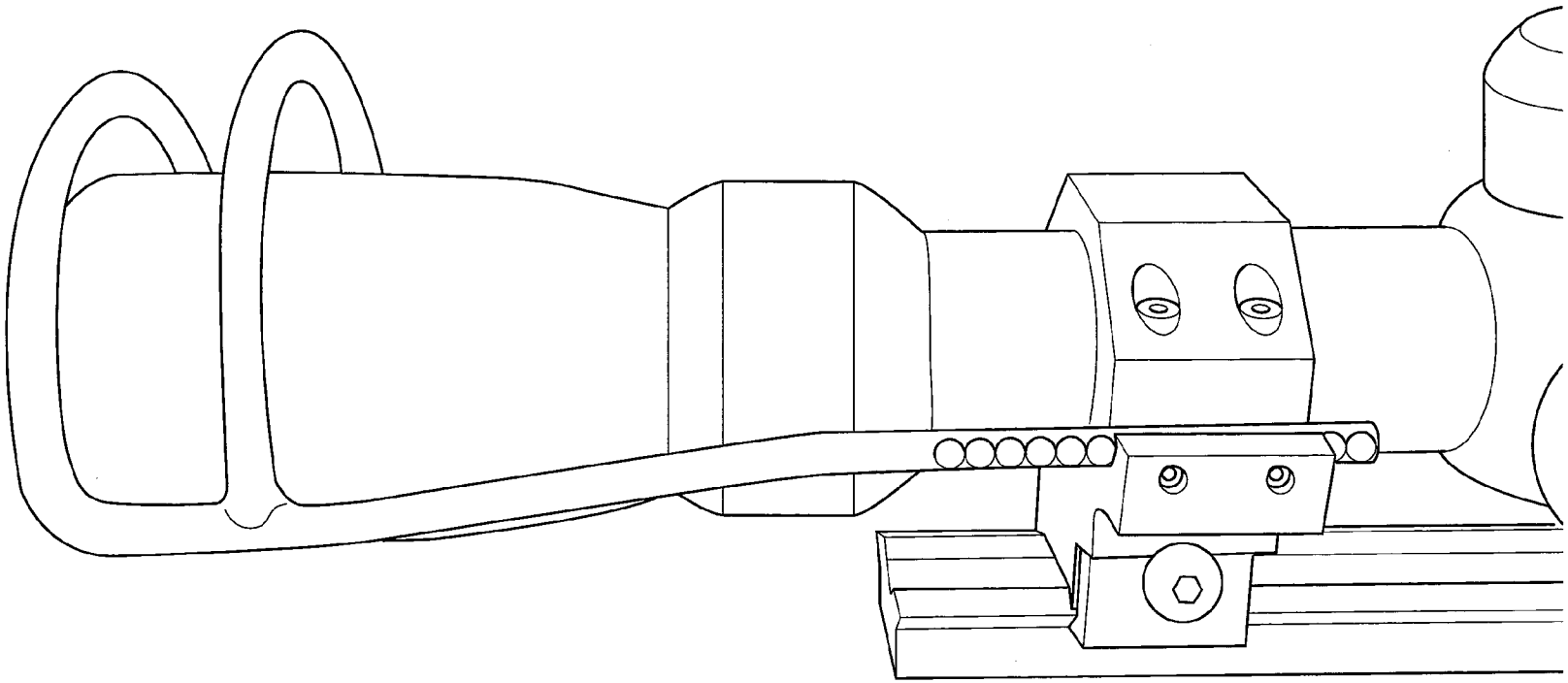
FIG. 15 depicts an enlarged right side elevational view of an embodiment of a rear scope guard frame and the slotted mounts of FIG. 1, shown in use with the second scope and a firearm track mounting portion.
Figure 16:
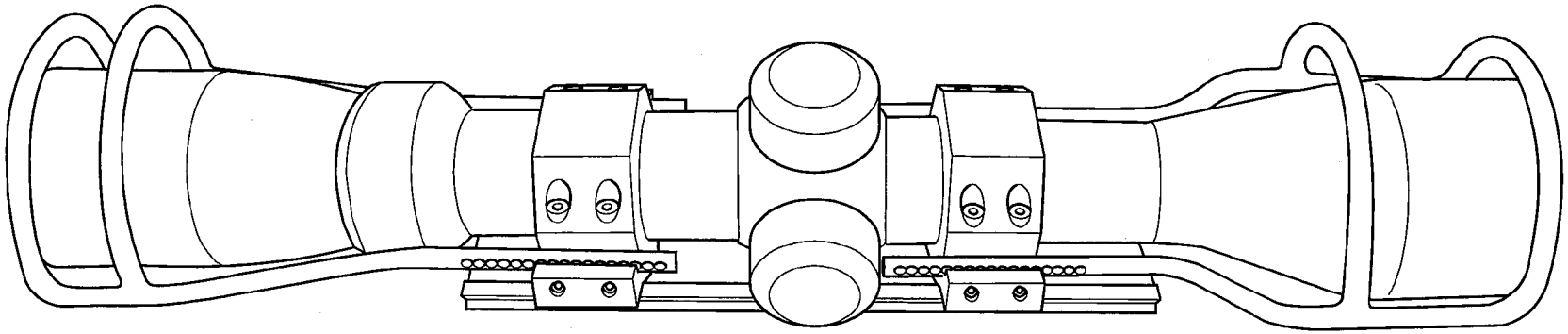
FIG. 16 depicts a top right perspective view of an embodiment of the front and rear scope guards and the slotted mounts of FIG. 1, shown in use with the second scope.
Figure 17:
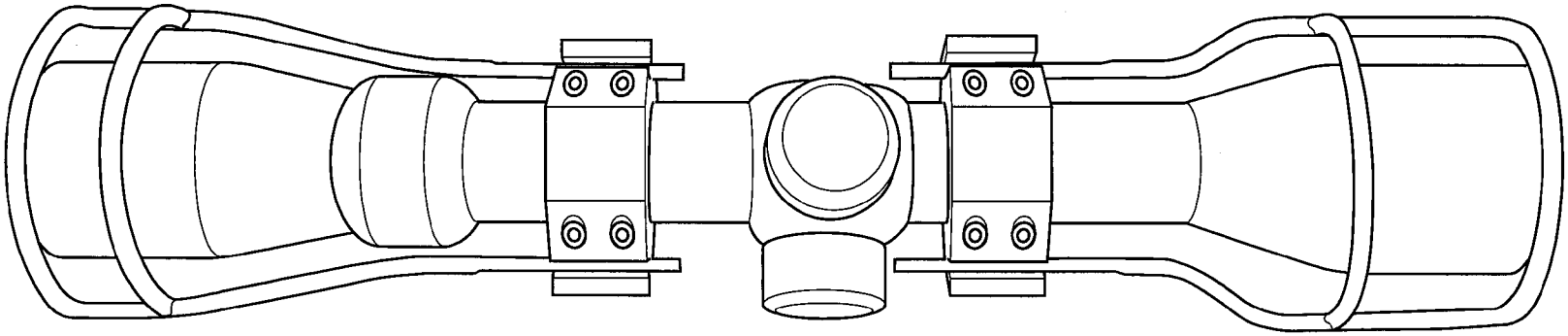
FIG. 17 depicts top plan view of an embodiment of the front and rear scope guards and the slotted mounts of FIG. 1, shown in use with the second scope.
Figure 18:
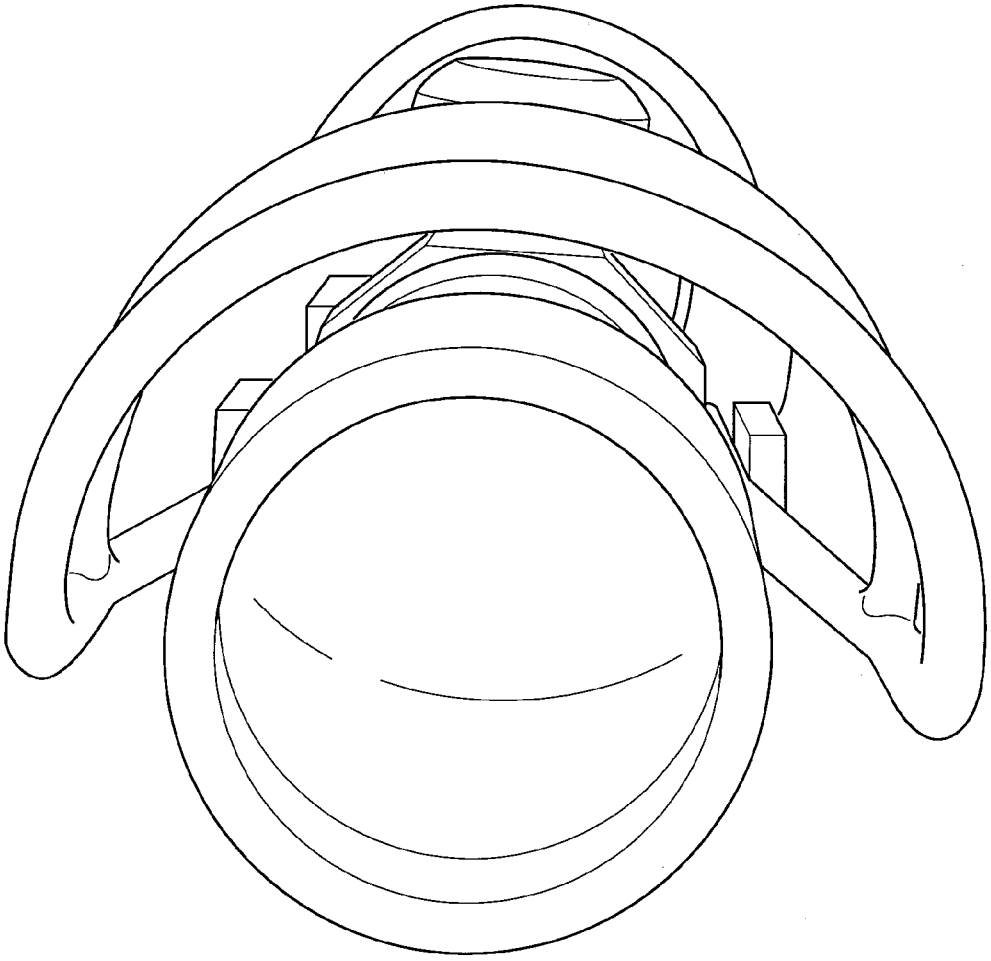
FIG. 18 depicts an enlarged rear elevational view of an embodiment of the rear scope guard frame and the slotted mounts of FIG. 2.
Figure 19:
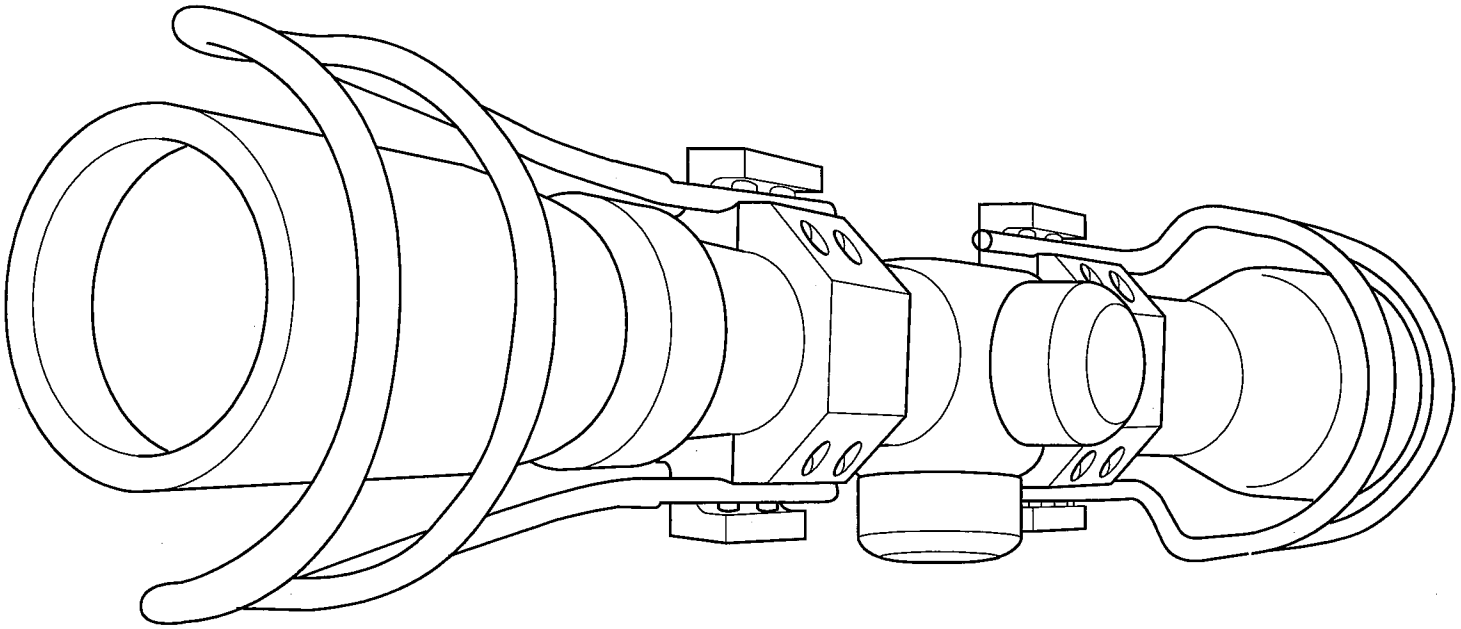
FIG. 19 depicts a top rear perspective view of an embodiment of the rear and front scope guards and the slotted mounts, shown in use with the second scope.
Figure 20:
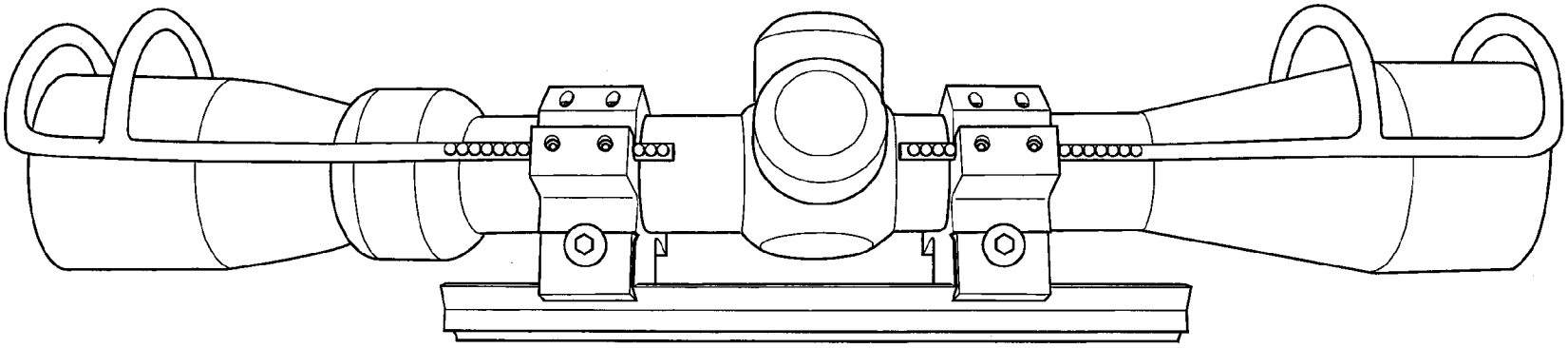
FIG. 20 depicts a right side perspective view of an embodiment of the front and rear scope guards and slotted mounts of FIG. 1, shown in use with the second scope and a firearm track mounting portion.
Figure 21:
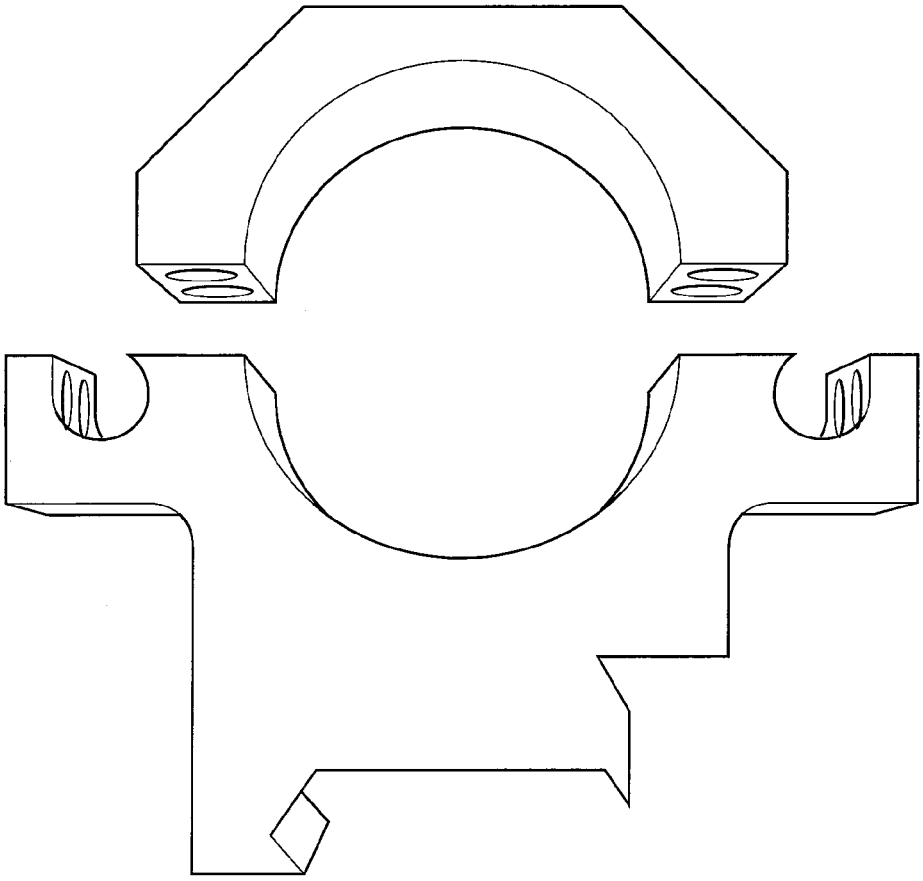
FIG. 21 depicts an exploded rear elevational view of an embodiment of the slotted mounts of FIG. 9.
Figure 22:
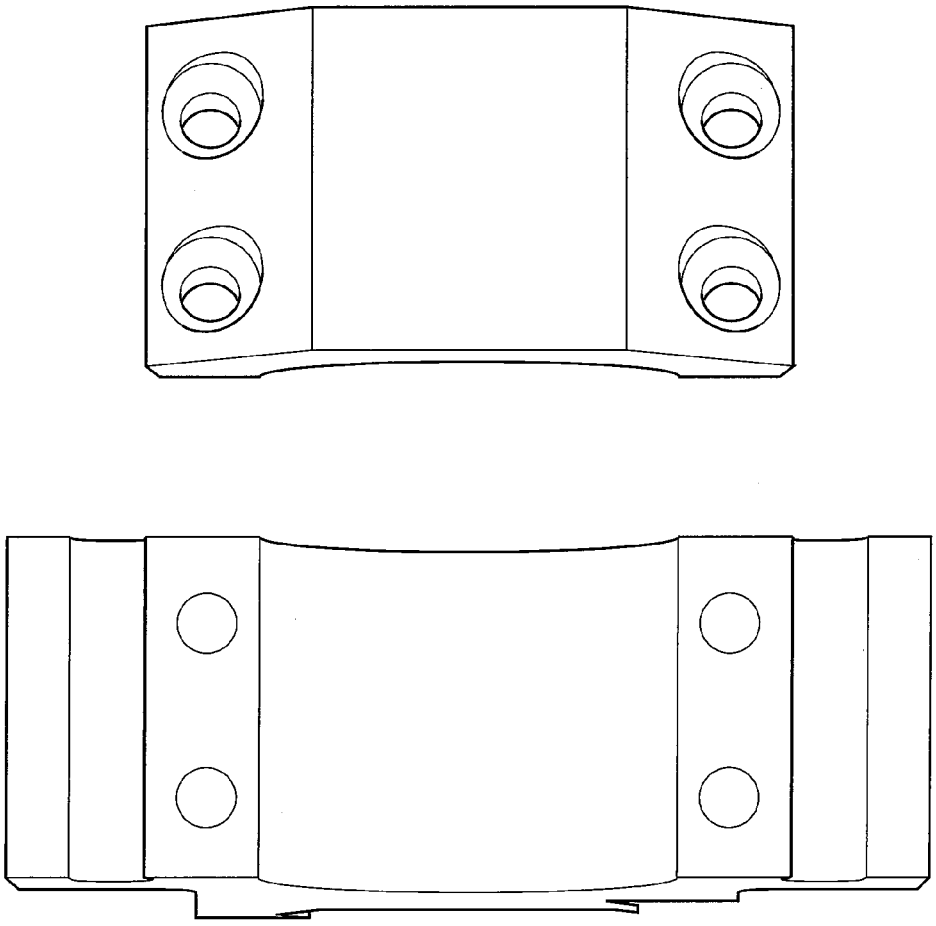
FIG. 22 depicts an exploded top perspective view of an embodiment of the slotted mounts of FIG. 9.
Figure 23:
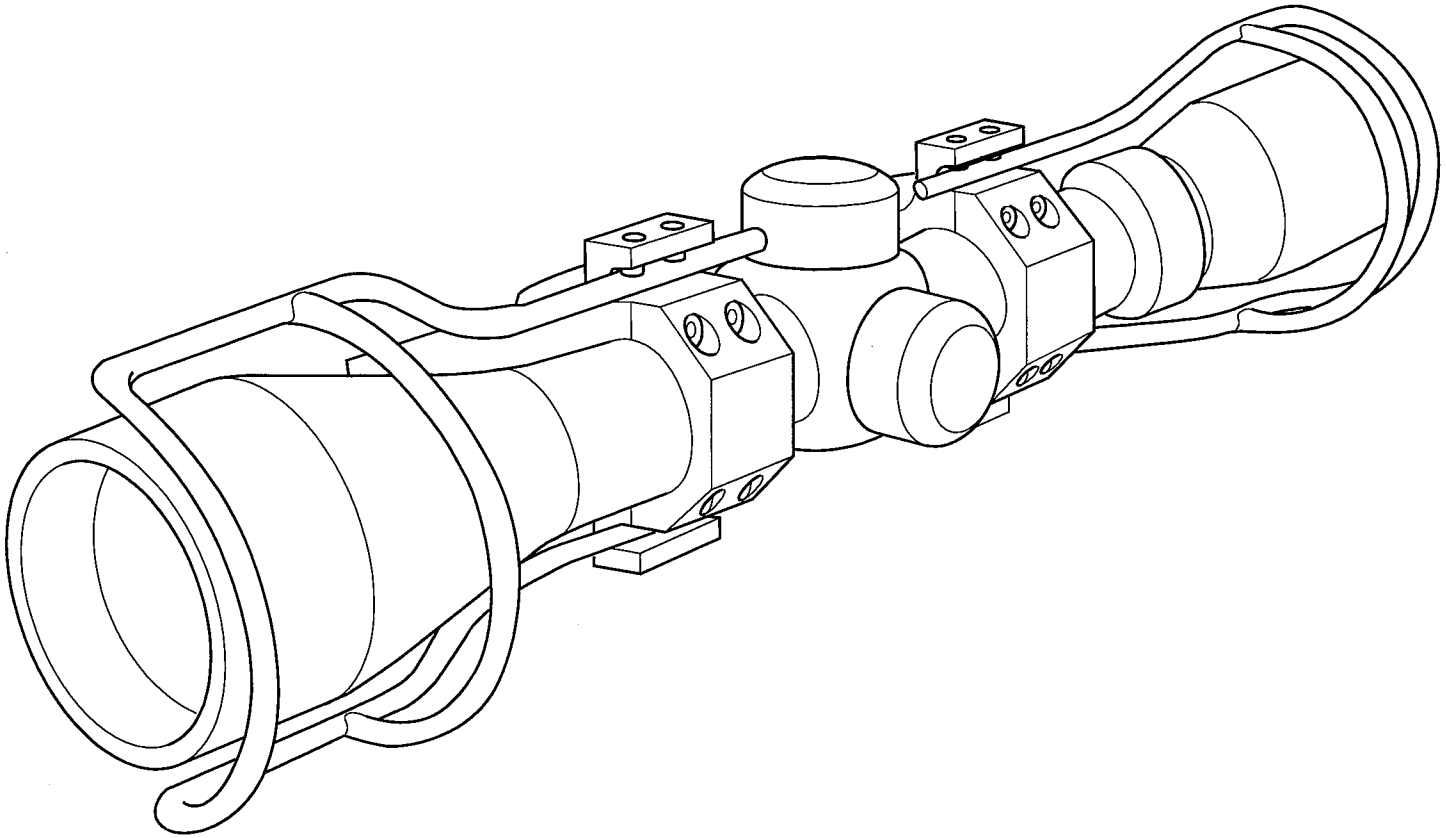
FIG. 23 depicts a top front left perspective view of an embodiment of the front and rear scope guards and the slotted mounts of FIG. 1, shown in use with the second scope.
Figure 24:
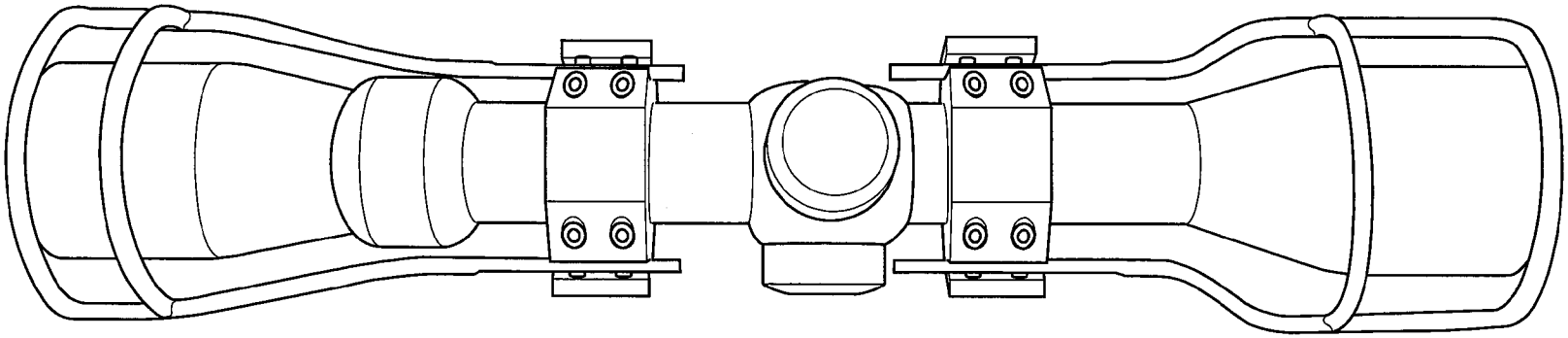
FIG. 24 depicts a top plan view of an embodiment of the front and rear scope guards and the slotted mounts of FIG. 1, shown in use with the second scope.
Figure 25:
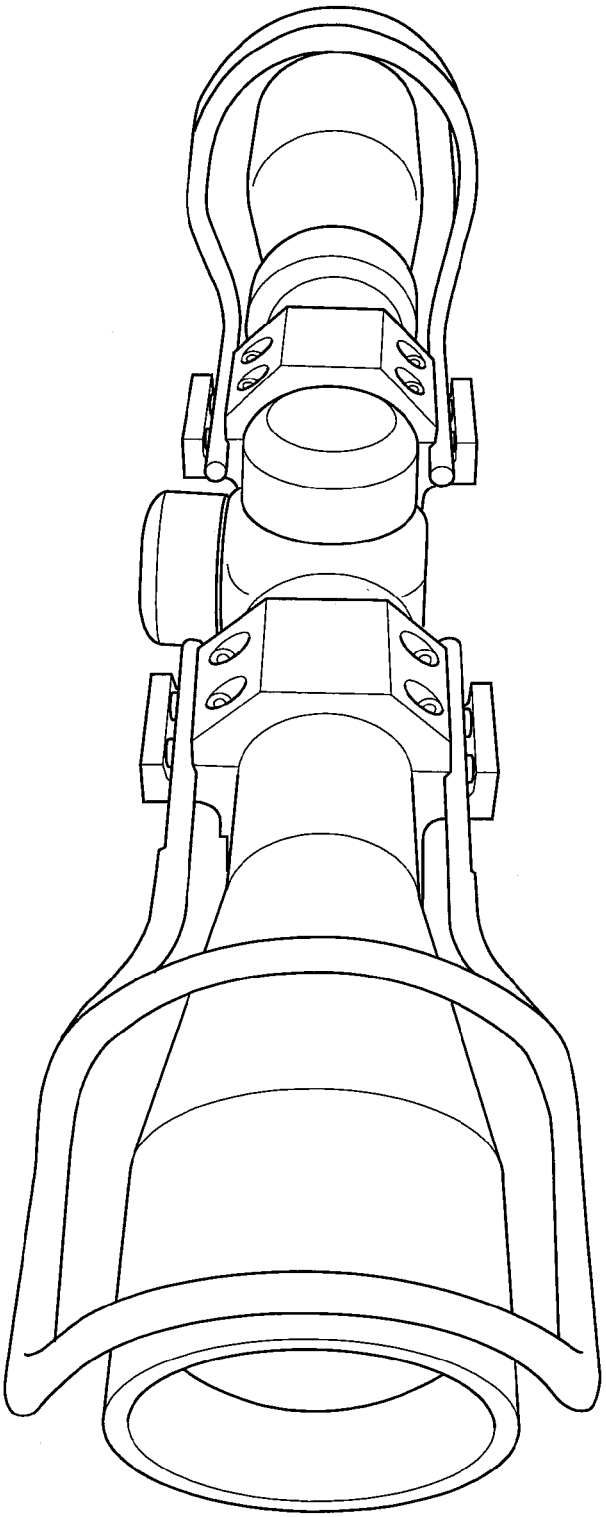
FIG. 25 depicts a top front perspective view of an embodiment of the front and rear scope guards and the slotted mounts of FIG. 1, shown in use with the second scope.
Figure 26:
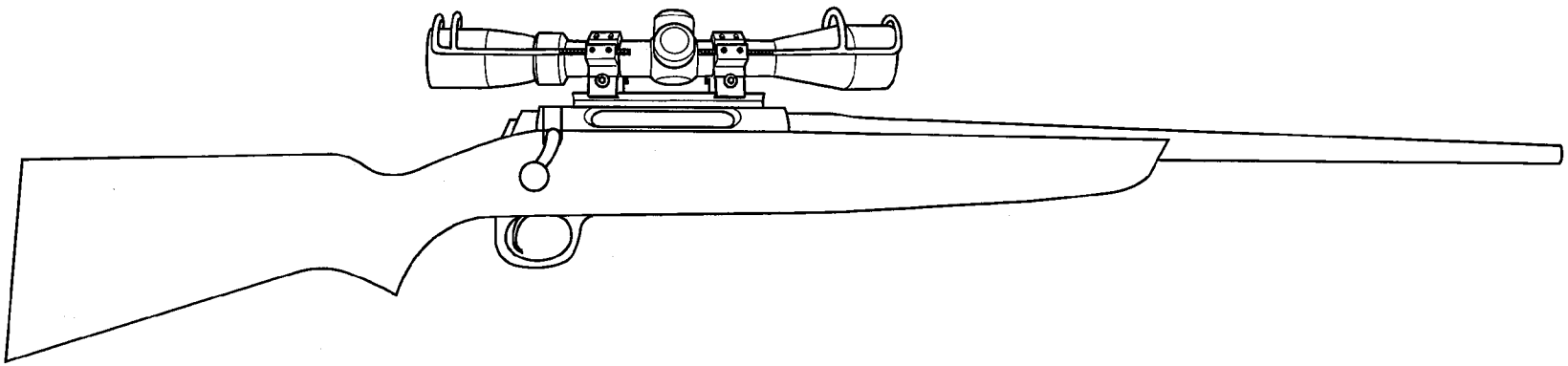
FIG. 26 depicts a side perspective view of an embodiment of the front and rear scope guards and the slotted mounts of FIG. 1, according to preferred embodiments, shown in use, mounted on a firearm with a first scope mounted thereon.
Figure 27:
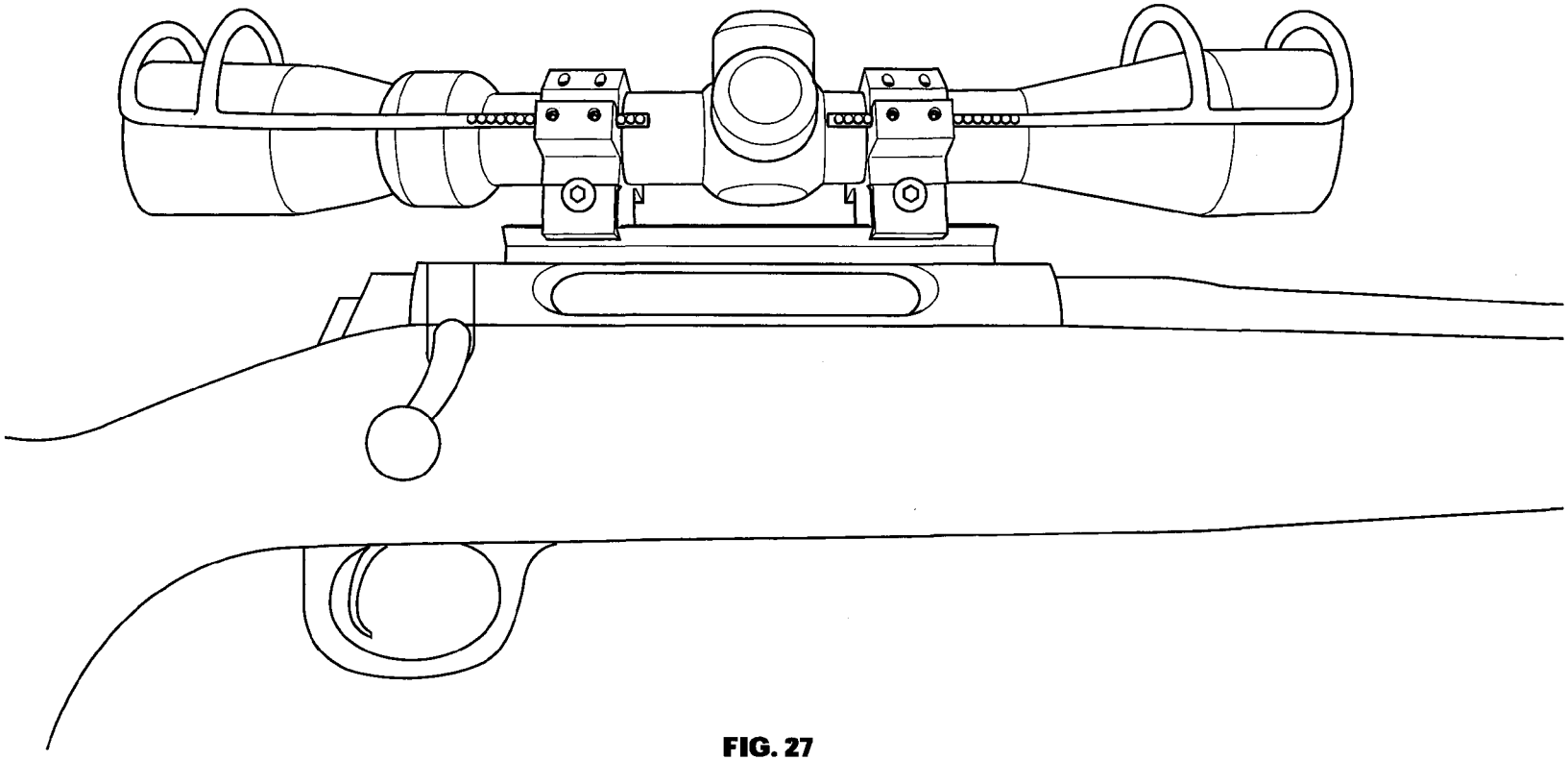
FIG. 27 depicts an enlarged side perspective view of an embodiment of the front and rear scope guards and the slotted mounts of FIG. 1, according to preferred embodiments, shown in use, mounted on a firearm with a first scope mounted thereon.
Figure 28:
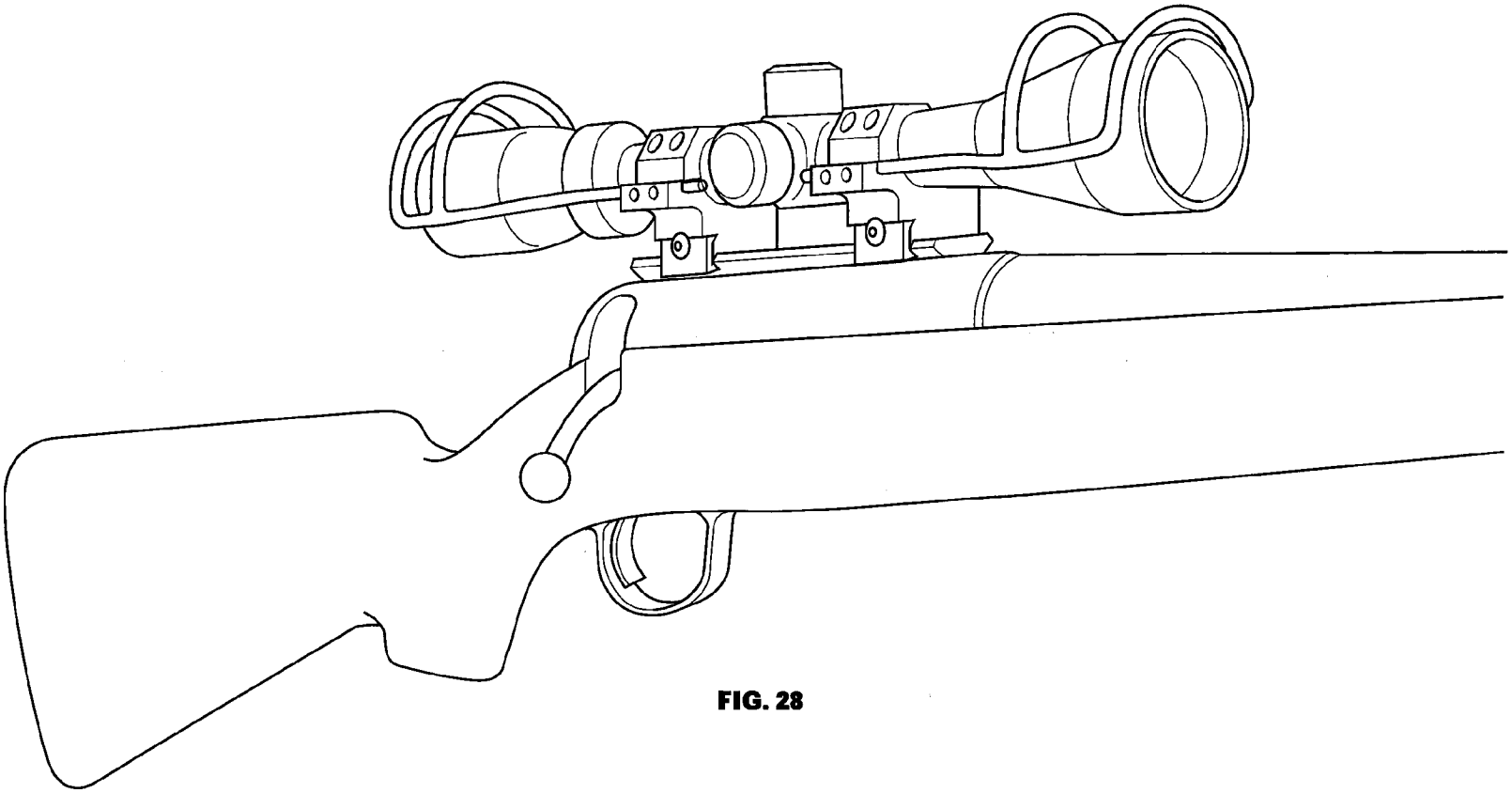
FIG. 28 depicts a side front left perspective view of an embodiment of the front and rear scope guards and the slotted mounts of FIG. 1, according to preferred embodiments, shown in use, mounted on a firearm with a first scope mounted thereon.
Figure 29:
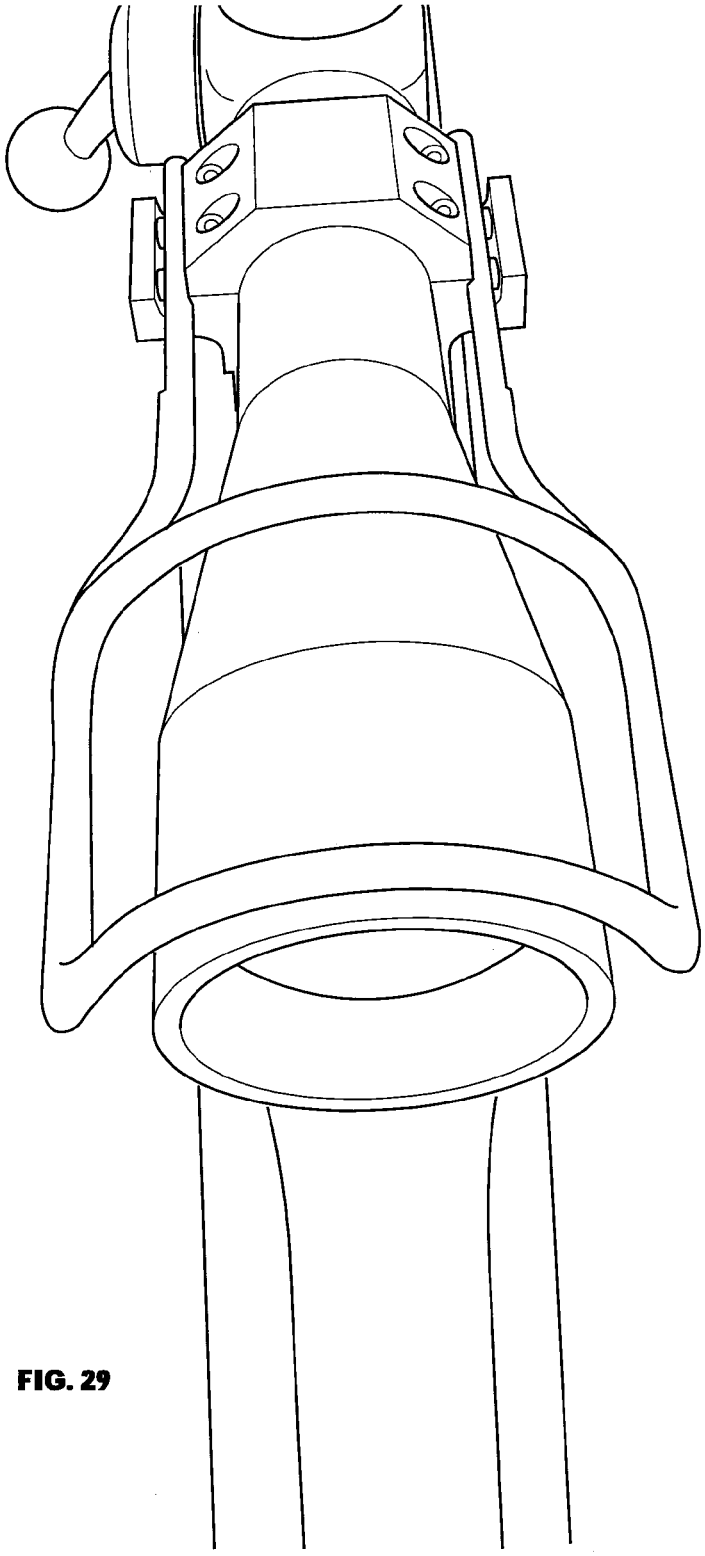
FIG. 29 depicts an enlarged top front left perspective view of an embodiment of the front scope guard frame and the slotted mounts of FIG. 1 according to preferred embodiments, shown in use, mounted on a firearm with a first scope mounted thereon.
Figure 30:
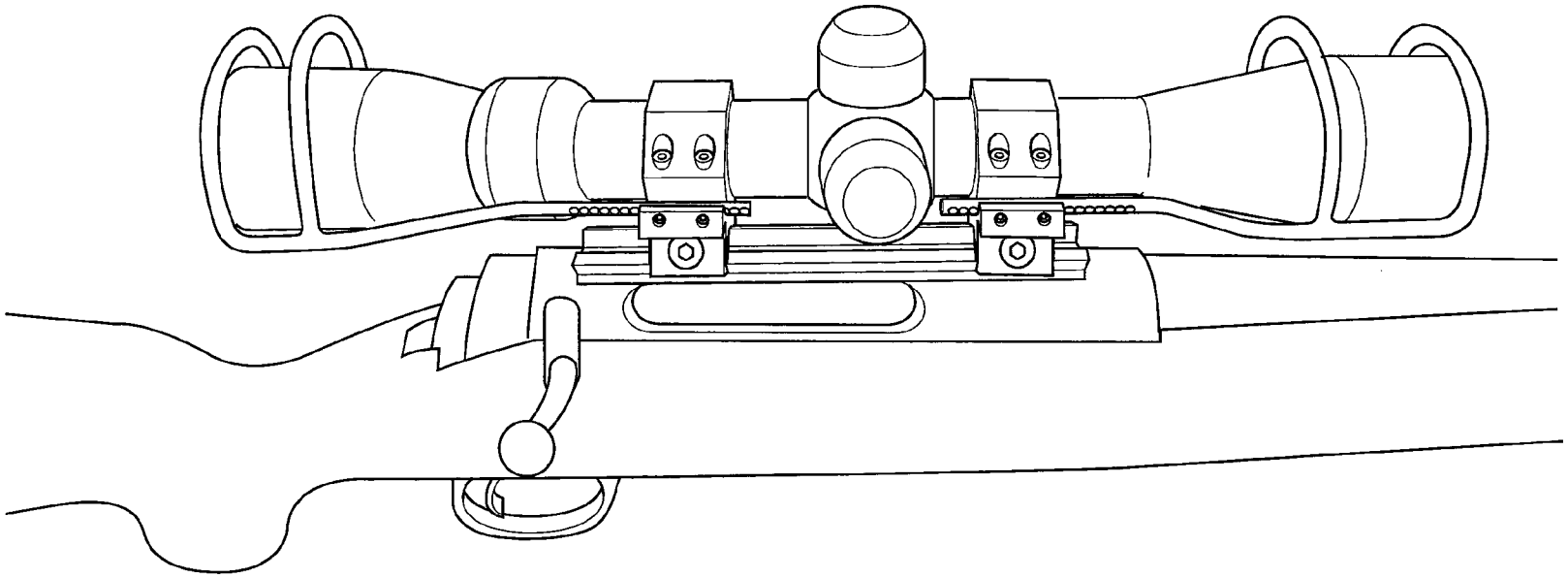
FIG. 30 depicts an enlarged top side perspective view of an embodiment of the front scope guard frame and the rear scope guard frame and the slotted mounts of FIG. 1, according to preferred embodiments, shown in use, mounted on a firearm with a first scope mounted thereon.
Figure 31:
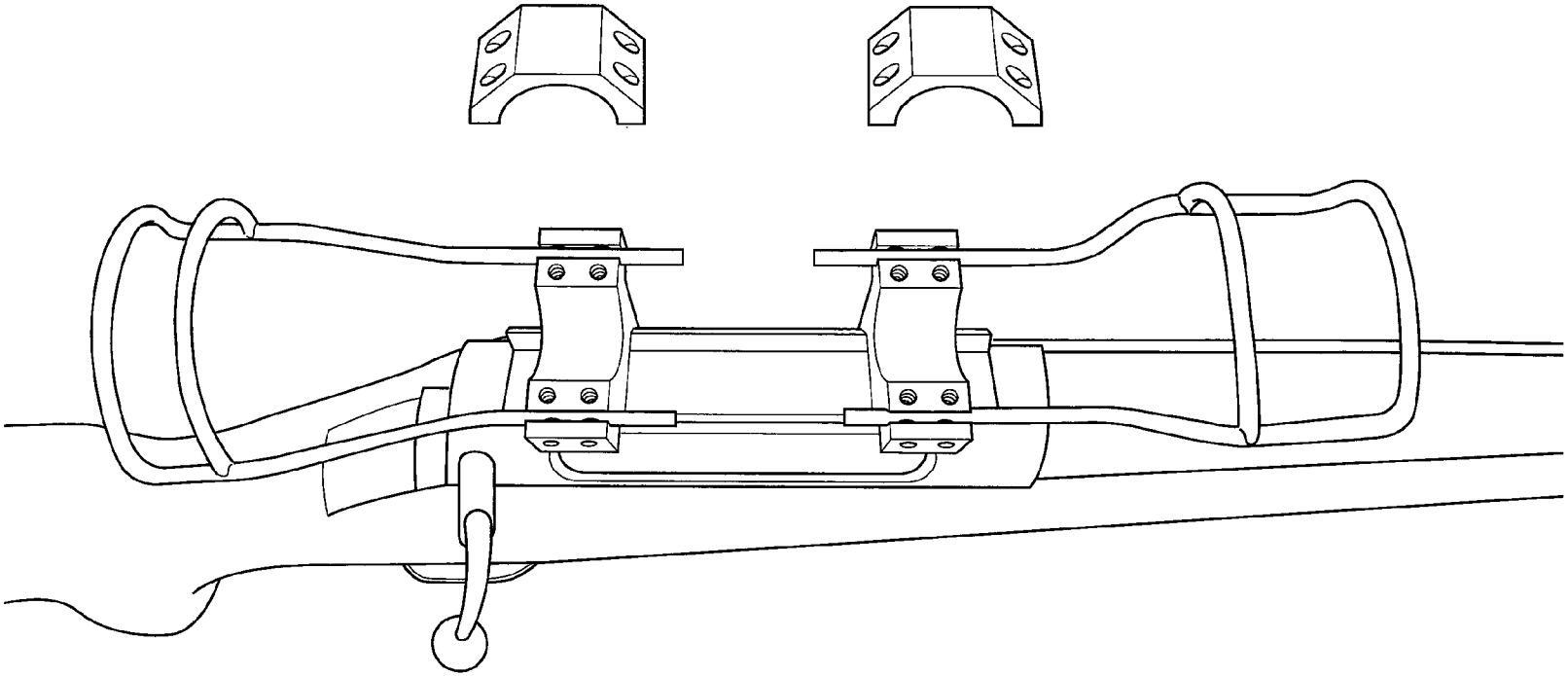
FIG. 31 depicts an exploded top side perspective view of an embodiment of the front scope guard frame and the rear scope guard frame and the slotted mounts of FIG. 1, shown in use, mounted on a firearm.
Figure 32:
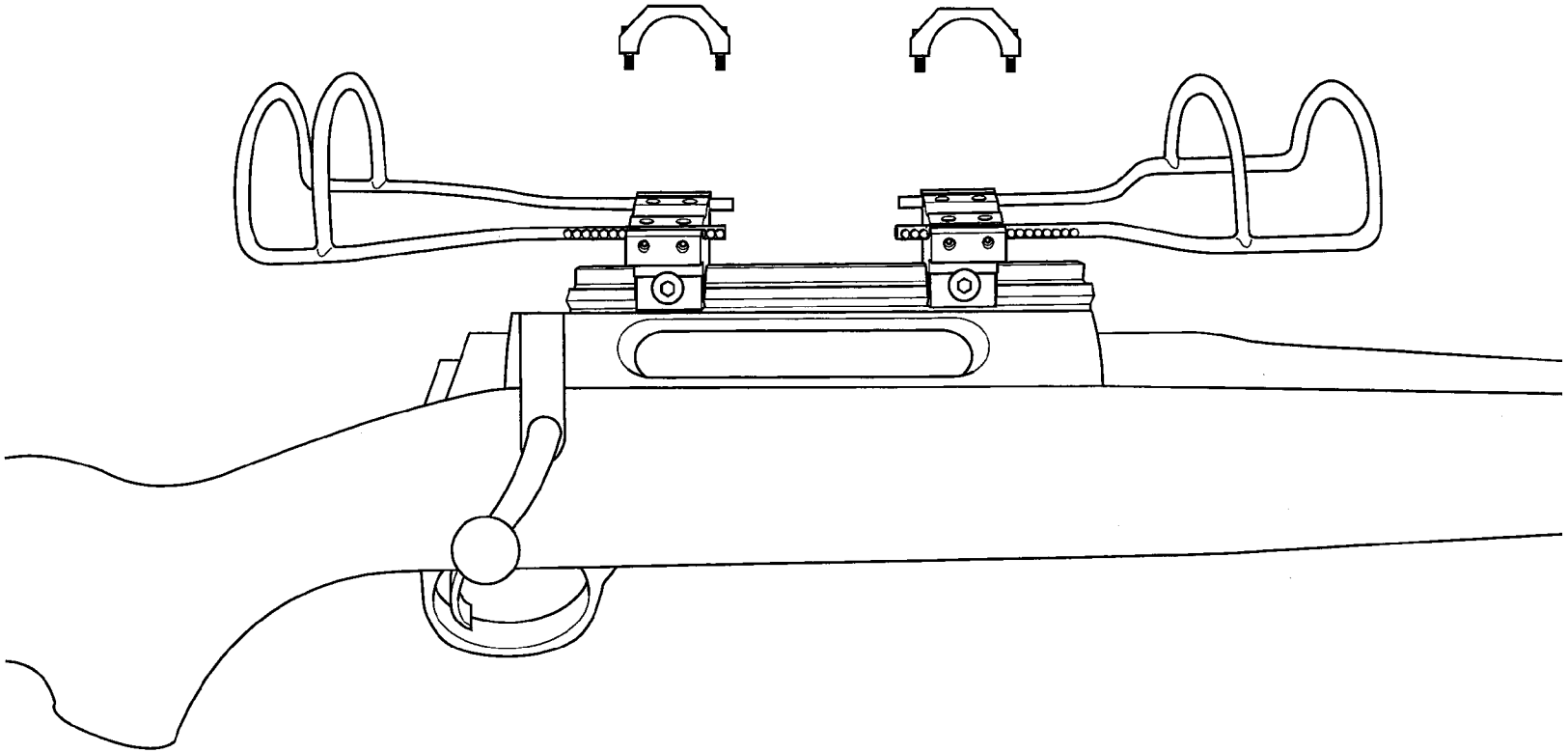
FIG. 32 depicts an exploded side perspective view of an embodiment of the front scope guard frame and the rear scope guard frame and the slotted mounts of FIG. 1, shown in use, mounted on a firearm.
Figure 33:
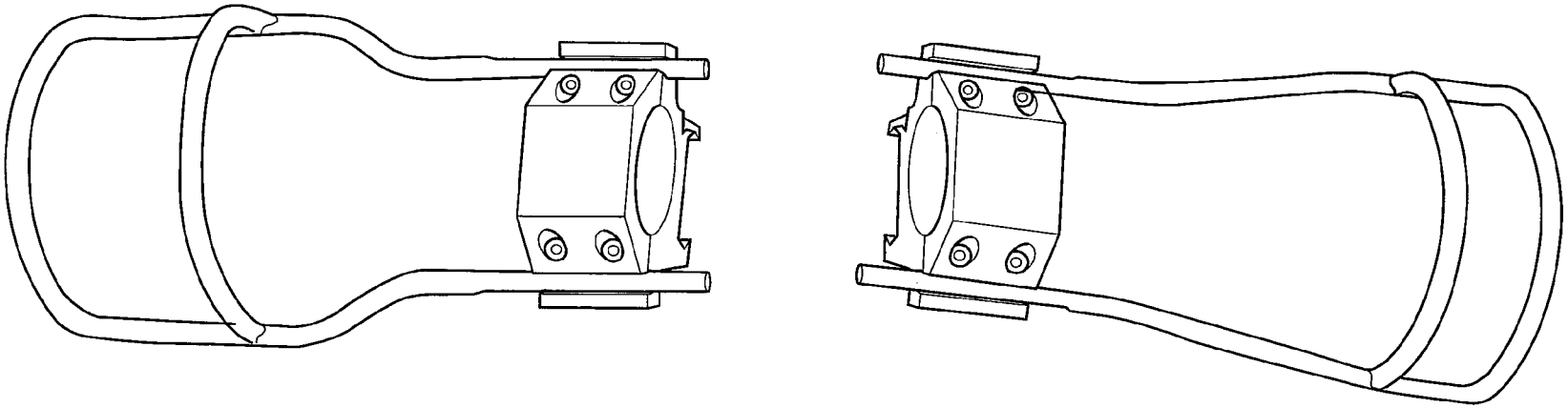
FIG. 33 depicts a top plan view of an embodiment of the front scope guard frame and the rear scope guard frame and the slotted mounts of FIG. 4.
Figure 34:
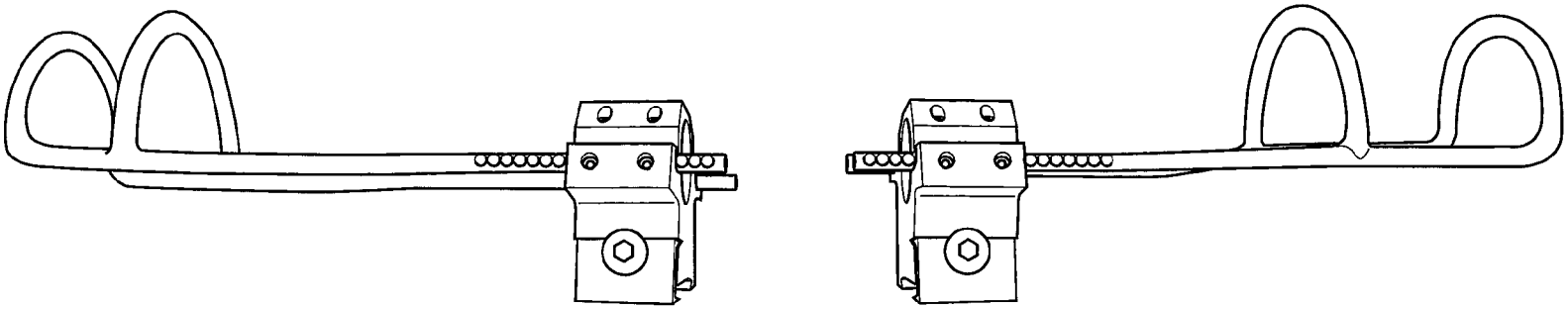
FIG. 34 depicts a right side elevational view of an embodiment of the front scope guard frame and the rear scope guard frame and the slotted mounts of FIG. 3.
Figure 35:
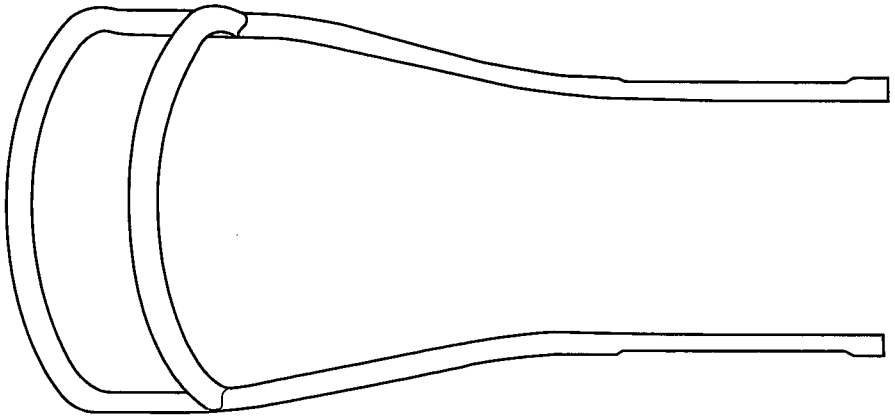
FIG. 35 depicts a top plan view of an embodiment of the rear scope guard frame of FIG. 4.
Figure 36:
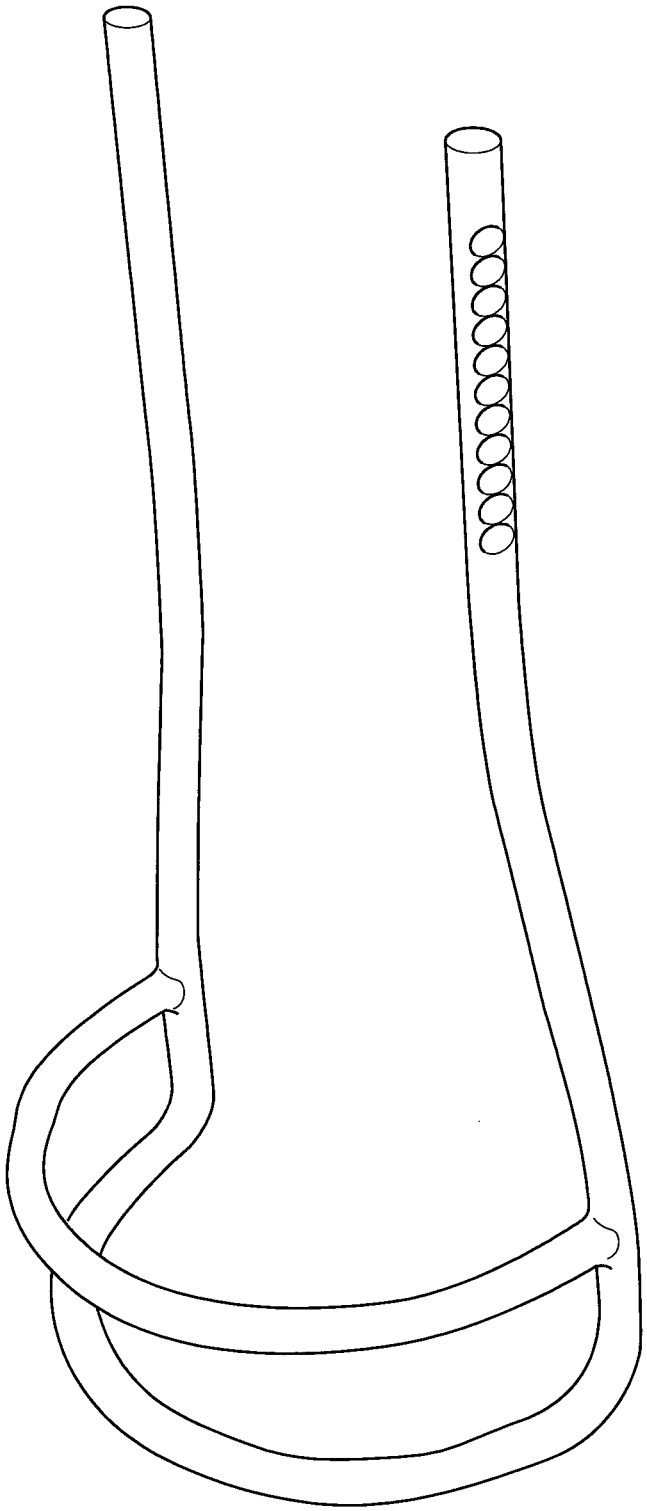
FIG. 36 depicts a top rear left elevational view of an embodiment of the rear scope guard frame of FIG. 4.
Figure 37:
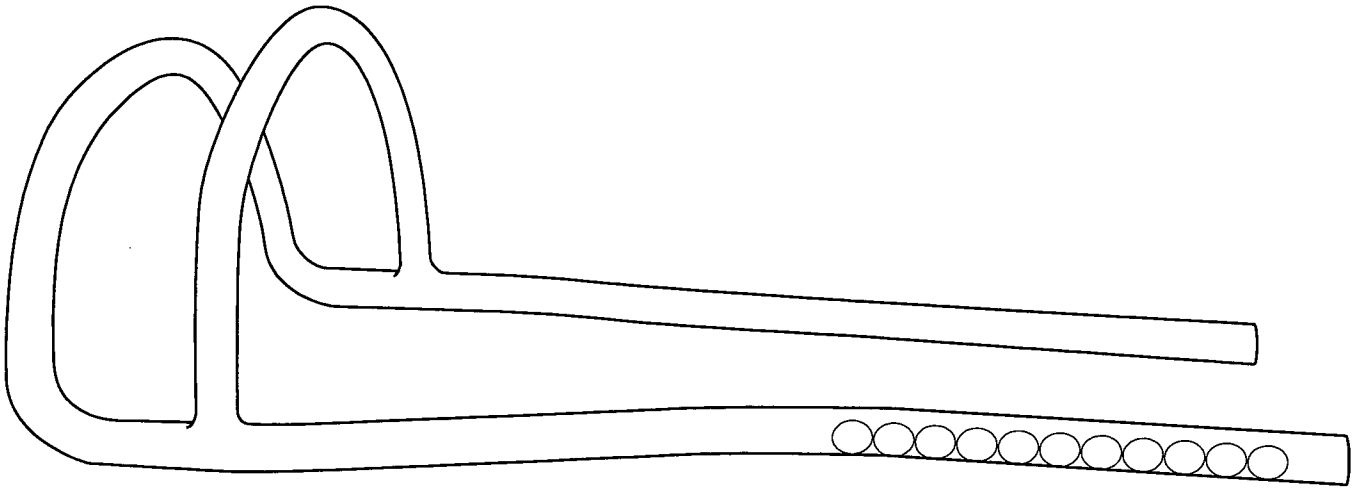
FIG. 37 depicts a right side elevational view of an embodiment of the rear scope guard frame of FIG. 4.
Figure 38:
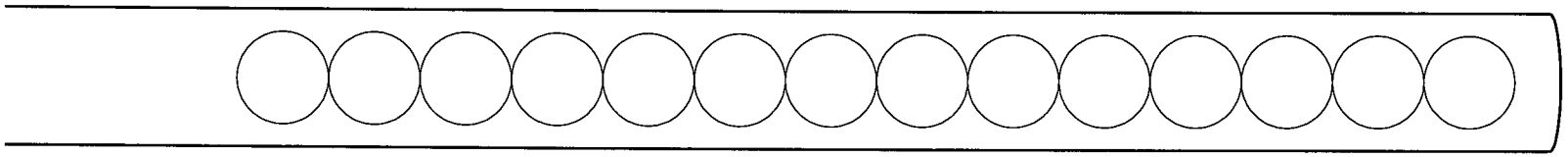
FIG. 38 depicts an enlarged left side elevational view of an embodiment of the arm connecting member of the inner arm extension of FIG. 7.

Referring to FIGS. 11 to 13, there are shown other preferred embodiments. In the embodiment shown in FIGS. 11 and 12, a guard section 130 (also called an elevatable hinged guard section, a hinged guard section, a selectively interposable guard section, etc.) is preferably provided with a guard cover portion 126. Preferably, the guard section 130 may be selectively moved between a closed configuration and an opened configuration. In the opened configuration (shown in FIG. 11), the guard cover portion 126 is preferably raised or elevated out from between the front and rear mounts 105*a*, the back top clamp 105*b*, the front bottom slotted mount 106*a*, the back bottom slotted mount 106*b*, the front mount rail clamp 115*a*, and/or the back mount rail clamp 115*b*. In the closed configuration (shown in FIG. 12), the guard cover portion 126 is interposed between the front and rear mounts 105*a*, the back top clamp 105*b*, the front bottom slotted mount 106*a*, the back bottom slotted mount 106*b*, the front mount rail clamp 115*a* and the back mount rail clamp 115*b*. The guard cover portion 126 is preferably constructed of a metal material. In the closed configuration, the guard cover portion 126 preferably covers (at least in part) the top and sides of a center portion of the scope assembly 104, where an elevation adjustment 131 and the parallax and windage adjustments 132 of the scope assembly 104 may be located. The guard section 130 selectively exposes (in the opened configuration) and protects (in the closed configuration) the elevation adjustment 131 and the parallax and windage adjustments 132 of the scope assembly 104.

More particularly, the guard cover portion 126 of the guard section 130 is preferably connected to the rest of the protective scope guard by a hinge member 129. The hinge member 129 is preferably provided at or near a top portion of a first one of the top mount portions (e.g., on the front of the top mount portion). As best seen in FIG. 12, the hinge member 129 may include a hinge rod 133. The guard cover portion 126 may preferably be selectively and releasably fastened in the closed configuration, FIG. 12, by any convenient form of closure, e.g., a spring latch. For example, as shown in FIGS. 11 and 12, a resilient latch extension 128 is preferably provided at or near a top portion of a second one of the top mount portions (e.g., on the rear of the top mount portion) and resiliently and releasably interlocks with a rod extension 127 provided on the guard cover portion 126, near a transverse center of the guard section 130. The hinge member 129 preferably may be of a type that yieldingly and releasably holds the guard cover portion 126 in the opened configuration, after it passes a dead center position. Regular non-locking hinges may also be utilized.

As should be appreciated from FIG. 13, some preferred embodiments of the protective scope guard may include an outer guard 134 (also called an expanded outer guard cover) which is provided over one or more of (and preferably all of) the front side scope guard frame 102*a*, the back side scope guard frame 102*b*, the first front top scope guard frame 103*a*, the first back top scope guard frame 103*b*, the second front top scope guard frame 110*a* and the second back top scope guard frame 110*b*. The outer guard 134 is preferably constructed of a metal material, and it preferably covers the top and sides of the front side scope guard frame 102*a*, the back side scope guard frame 102*b*, the first front top scope guard frame 103*a*, the first back top scope guard frame 103*b*, the second front top scope guard frame 110*a* and the second back top scope guard frame 110*b*, and the top and sides of one end portion of the scope assembly 104. An instance of the outer guard 134 is positioned at opposite ends of the protective scope guard. Each instance of the outer guard 134 is configured to protect the scope assembly 104 from possible damage and/or from being knocked out of alignment.

More particularly, the outer guard 134 is preferably permanently affixed to the semi-cylindrical skeletal frame provided by the outer body portion and the inner body portion of the protective scope guard. The outer guard 134 is preferably sufficiently long to cover an end portion of the scope assembly 104, preferably without obstructing the use of its power ring zoom adjuster 135 while the protective scope guard is in use.

Other than as shown in FIGS. 11 to 13, these embodiments preferably may be the same as described above and shown in FIGS. 1 to 10.

It should be appreciated that, although some of the components, relations, and/or configurations of the guards and/or mounts according to an embodiment are not specifically referenced in association with one another, and they may be used in association therewith.

All of the aforementioned, depicted and various structures, configurations, relationships, utilities and the like may be, but are not necessarily, incorporated into and/or achieved by an embodiment. Any one or more of the aforementioned structures, configurations, relationships, utilities and the like may be implemented in and/or by the embodiment, on their own, and/or without reference, regard or likewise implementation of any of the other aforementioned structures, configurations, relationships, utilities and the like, in various permutations and combinations, as will be readily apparent to those skilled in the art, without departing from the pith, marrow, and spirit of the disclosed embodiments.

It is to be understood that the forms of the embodiments herewith shown and described are to be taken as preferred examples of the same, and that various changes in the shape, size and arrangement of parts may be resorted to, without departing from the spirit of the embodiments.

Other modifications and alterations may be used in the design and manufacture of other embodiments according to the present embodiments without departing from the spirit and scope of the embodiments, which is limited only by the claims of any regular patent applications claiming priority herefrom.

In view of the foregoing, there is depicted and described a protective scope guard for the scope assembly 104 mountable to the firearm 108. The protective scope guard is configured to prevent damage to the scope assembly 104 and knocking the scope assembly 104 out of proper alignment. It allows normal usage of the scope assembly 104 while the protective scope guard is on the firearm 108. In some embodiments, a hinged section of the protective scope guard may be elevated to expose elevation adjustments, windage adjustments 132 and parallax adjusters of the scope assembly 104. In some embodiments, an outer guard 134 (also called an expanded metal guard cover) allows for additional protection of the ends of the scope assembly 104 without obstructing a power ring zoom adjuster 135 of the scope assembly 104. The protective scope guard is lightweight but sturdy, and is affixed to slotted mounts 105*a*, the back top clamp 105*b*, the front bottom slotted mount 106*a*, the back bottom slotted mount 106*b*, the front mount rail clamp 115*a* and the back mount rail clamp 115*b* to provide uniform horizontal adjustability of the protective scope guard to accommodate the various lengths of different instances of the scope assembly 104.

In view of the foregoing, there is depicted and described an apparatus for a scope assembly 104, a firearm 108 having a gun barrel 109, and a mounting rail 107 securely mountable to the gun barrel 109 of the firearm 108. The apparatus includes (and is not limited to) a mount (such as, the front top clamp 105*a*, the front bottom slotted mount 106*a*, the front mount rail clamp 115*a* and/or the back top clamp 105*b*, the back bottom slotted mount 106*b* and the back mount rail clamp 115*b*). The mount is configured to selectively releasably securely affix to the mounting rail 107 of the firearm 108 in such a way that the mounting rail 107 provides stable positioning of the mount once the mount is affixed to the mounting rail 107. The apparatus also includes (and is not limited to) a rigid protective scope guard frame (such as, the front side scope guard frame 102*a*, the first front top scope guard frame 103*a*, the second front top scope guard frame 110*a*, the back side scope guard frame 102*b*, the first back top scope guard frame 103*b*, and the second back top scope guard frame 110*b*). The rigid protective scope guard frame is configured to selectively securely affix to the mount. The rigid protective scope guard frame is also configured to surround, at least in part, the scope assembly 104 once the rigid protective scope guard frame is affixed to the mount. The rigid protective scope guard frame is also configured to allow normal usage of the scope assembly 104 once the rigid protective scope guard frame is affixed to the mount.

In view of the foregoing, there is depicted and described an apparatus. The apparatus includes (and is not limited to): (A) a scope assembly 104; (B) a firearm 108 having a gun barrel 109; (C) a mounting rail 107 securely mountable to the gun barrel 109 of the firearm 108; (D) a mount configured to selectively releasably securely affix to the mounting rail 107 of the firearm 108 in such a way that the mounting rail 107 provides stable positioning of the mount once the mount is affixed to the mounting rail 107; and (E) a rigid protective scope guard frame configured to selectively securely affix to the mount, the rigid protective scope guard frame is also configured to surround, at least in part, the scope assembly 104 once the rigid protective scope guard frame is affixed to the mount, and the rigid protective scope guard frame is also configured to allow normal usage of the scope assembly 104 once the rigid protective scope guard frame is affixed to the mount.

In view of the foregoing, there is depicted and described an apparatus for a scope assembly 104, a firearm 108 having a gun barrel 109, and a mounting rail 107 securely mountable to the gun barrel 109 of the firearm 108. The apparatus includes (and is not limited to): (A) a front top clamp 105*a*, the front bottom slotted mount 106*a*, the front mount rail clamp 115*a* configured to selectively releasably securely affix to a front rail section of the mounting rail 107 of the firearm 108 in such a way that the mounting rail 107 provides stable positioning of the front mount; (B) a back top clamp 105*b*, the back bottom slotted mount 106*b* and the back mount rail clamp 115*b* configured to selectively releasably securely affix to a rear section of the mounting rail 107 of the firearm 108 in such a way that the mounting rail 107 provides stable positioning of the rear mount; (C) a front side scope guard frame 102*a*, a first front top scope guard frame 103*a*, a second front top scope guard frame 110*a* configured to selectively securely affix to the front top clamp 105*a*, the front bottom slotted mount 106*a*, the front mount rail clamp 115*a*, and the rigid protective front scope guard frame is also configured to surround, at least in part, a front scope section of the scope assembly 104 once the rigid protective front scope guard frame is affixed to the front mount, and the rigid front protective scope guard frame is also configured to allow normal usage of the scope assembly 104 once the rigid front protective scope guard frame is affixed to the front mount; and (D) a back side scope guard frame 102*b*, a first back top scope guard frame 103*b*, a second back top scope guard frame 110*b* configured to selectively securely affix to the back top clamp 105*b*, the back bottom slotted mount 106*b* and the back mount rail clamp 115*b*, and the rigid protective rear scope guard frame is also configured to surround, at least in part, a rear portion of the scope assembly 104 once the rigid protective front scope guard frame is affixed to the front mount; and the rigid rear protective scope guard frame is also configured to allow normal usage of the scope assembly 104 once the rigid rear protective scope guard frame is affixed to the rear mount.

In view of the foregoing, there is depicted and described an apparatus. The apparatus includes (and is not limited to): (A) a scope assembly 104, (B) a firearm 108 having a gun barrel 109, (C) a mounting rail 107 securely mountable to the gun barrel 109 of the firearm 108; (D) a front top clamp 105*a*, the front bottom slotted mount 106*a*, the front mount rail clamp 115*a* configured to selectively releasably securely affix to a front rail section of the mounting rail 107 of the firearm 108 in such a way that the mounting rail 107 provides stable positioning of the front mount; (E) a back top clamp 105*b*, the back bottom slotted mount 106*b* and the back mount rail clamp 115*b* configured to selectively releasably securely affix to a rear section of the mounting rail 107 of the firearm 108 in such a way that the mounting rail 107 provides stable positioning of the rear mount; (F) a front side scope guard frame 102*a*, a first front top scope guard frame 103*a*, and a second front top scope guard frame 110*a* configured to selectively securely affix to the front top clamp 105*a*, the front bottom slotted mount 106*a*, the front mount rail clamp 115*a*, and the rigid protective front scope guard frame is also configured to surround, at least in part, a front scope section of the scope assembly 104 once the rigid protective front scope guard frame is affixed to the front mount, and the rigid front protective scope guard frame is also configured to allow normal usage of the scope assembly 104 once the rigid front protective scope guard frame is affixed to the front mount; and (G) a back side scope guard frame 102*b*, a first back top scope guard frame 103*b*, and a second back top scope guard frame 110*b* configured to selectively securely affix to the back top clamp 105*b*, the back bottom slotted mount 106*b* and the back mount rail clamp 115*b*, and the rigid protective rear scope guard frame is also configured to surround, at least in part, a rear portion of the scope assembly 104 once the rigid protective front scope guard frame is affixed to the front mount; and the rigid rear protective scope guard frame is also configured to allow normal usage of the scope assembly 104 once the rigid rear protective scope guard frame is affixed to the rear mount.

In accordance with a general embodiment (in view of the above description), an apparatus is provided for the scope assembly 104 having a front scope section and a back scope section. The apparatus is also provided for the firearm 108 including the mounting rail 107. The mounting rail 107 has a front rail section and a back rail section. The apparatus includes (and is not limited to) a combination of a mount, a front scope guard frame and a back scope guard frame. An example of the mount is provided by (and is not limited to) a combination of the front bottom slotted mount 106*a* and the back bottom slotted mount 106*b*. The mount is (in general terms) configured to selectively affix the mounting rail 107 to the scope assembly 104. An example of the front scope guard frame is provided by (and is not limited to) the front side scope guard frame 102*a*, which also may be called a rigid front protective scope guard frame. The front scope guard frame is (in general terms) configured to guard, at least in part, the front scope section of the scope assembly 104. An example of the back scope guard frame is provided by (and is not limited to) the back side scope guard frame 102*b*, which may also be called a rigid back protective scope guard frame. The back scope guard frame is (in general terms) configured to guard, at least in part, the back scope section of the scope assembly 104. The front scope guard frame and the back scope guard frame are each configured to be selectively positionable and movable. More specifically, the front scope guard frame and the back scope guard frame are selectively positionable and movable, independently of each other, relative to the mount. In addition, the front scope guard frame and the back scope guard frame are configured to selectively affix (directly or indirectly), independently of each other, to the mount once the front scope guard frame and the back scope guard frame are positioned just so. A technical effect of the above arrangement is that the apparatus may be custom fitted to a relatively wider variety of lengths of a relatively wider variety of scope assemblies manufactured by one or more different manufacturers. For instance, this arrangement reduces, at least in part, the cost of manufacturing of the apparatus for deployment with a relatively wider range of different types and/or models of the scope assembly 104. For instance, independent positioning and movement (adjustment) and affixing of the front scope guard frame and the back scope guard frame relative to the mount assists in the set-up of operative user access to the control knobs. These knobs may be associated with the relatively wider range of available instances of the scope assembly 104 currently deployed (and those to be deployed in the future).

It will be appreciated that in accordance with an embodiment, the apparatus includes (and is not limited to) a combination of: (A) the scope assembly 104 having the front scope section and the back scope section, (B) the firearm 108 including the mounting rail 107 having the front rail section and the back rail section, (C) the mount configured to selectively affix the mounting rail 107 to the scope assembly 104, (D) the front scope guard frame configured to guard, at least in part, the front scope section of the scope assembly 104, and (E) the back scope guard frame configured to guard, at least in part, the back scope section of the scope assembly 104. The front scope guard frame and the back scope guard frame are selectively positionable and movable, independently of each other, relative to the mount. The front scope guard frame and the back scope guard frame are configured to selectively affix (directly or indirectly), independently of each other, to the mount once the front scope guard frame and the back scope guard frame are positioned just so.

In accordance with a specific embodiment (or option), the apparatus is adapted in such a way that the mount includes a combination of a front mount and a back mount. An example of the front mount includes (and is not limited to) the front bottom slotted mount 106*a*. An example of the back mount includes (and is not limited to) the back bottom slotted mount 106*b*. The front mount and the back mount are configured to receive and to support the scope assembly 104. The front mount and the back mount are each selectively positionable and movable, independently of each other, relative to the front rail section and the back rail section, respectively, of the mounting rail 107. The front mount and the back mount are each configured to selectively affix (directly or indirectly), independently of each other, to the front rail section and the back rail section, respectively, of the mounting rail 107 once the front mount and the back mount are positioned just so.

In accordance with a specific embodiment (or option), the apparatus is adapted in such a way that the front scope guard frame and the back scope guard frame are each selectively positionable and movable, independently of each other, relative to the front mount and the back mount, respectively. The front scope guard frame and the back scope guard frame are each configured to selectively affix (directly or indirectly), independently of each other, to the front mount and the back mount, respectively once the front scope guard frame and the back scope guard frame are positioned just so.

In accordance with a specific embodiment (or option), the apparatus is adapted in such a way that the mount is configured to cradle, at least in part, an outer surface of the scope assembly 104.

In accordance with a specific embodiment (or option), the apparatus is adapted in such a way that the front scope guard frame and the back scope guard frame each includes (and is not limited to) a rounded cross-sectional rigid bar configured to be positioned along, at least in part, lateral sides of the scope assembly 104 once the front scope guard frame and the back scope guard frame are affixed to the mount.

In accordance with a specific embodiment (or option), the apparatus is adapted in such a way that the front scope guard frame includes (A) a front side scope guard frame 102*a* extending along the front lateral sides of the scope assembly 104; and (B) a first front top scope guard frame 103*a* extending from a front distal end of the front side scope guard frame 102*a*. The first front top scope guard frame 103*a* is configured to guard, at least in part, the front distal end of the front scope section of the scope assembly 104. The back scope guard frame includes (and is not limited to) (A) a back side scope guard frame 102*b* extending along back lateral sides of the scope assembly 104; and (B) a first back top scope guard frame 103*b* extending from a back distal end of the back side scope guard frame 102*b*. The first back top scope guard frame 103*b* is configured to guard, at least in part, the back distal end of the back scope section of the scope assembly 104.

In accordance with a specific embodiment (or option), the apparatus is adapted in such a way that the front scope guard frame includes (and is not limited to) a second front top scope guard frame 110*a* extending from a front distal end of the front side scope guard frame 102*a*. The second front top scope guard frame 110*a* is spaced apart from the first front top scope guard frame 103*a*. The second front top scope guard frame 110*a* is configured to guard, at least in part, a front top section of the scope assembly 104. The back scope guard frame includes (and is not limited to) a second back top scope guard frame 110*b* extending from a back distal end of the back side scope guard frame 102*b*. The second back top scope guard frame 110*b* is spaced apart from the first back top scope guard frame 103*b*. The second back top scope guard frame 110*b* is configured to guard, at least in part, a back top section of the scope assembly 104.

In accordance with a specific embodiment (or option), the apparatus is adapted in such a way that an outer guard 134 is provided and is configured to (A) connect to any one of the front scope guard frame and the back scope guard frame; and (B) protectively cover, at least in part, the top and sides of the scope assembly 104.

In accordance with a specific embodiment (or option), the apparatus is adapted in such a way that a guard section 130 is provided and is configured to be selectively affixed to, and span (spanned) between, the front scope guard frame and the back scope guard frame.

In accordance with another general embodiment (in view of the above description), an apparatus is provided for the scope assembly 104 having a front scope section and a back scope section. The apparatus is also provided for the firearm 108 including the mounting rail 107. The mounting rail 107 has a front rail section and a back rail section. The apparatus includes (and is not limited to) a combination of a front mount, a back mount, a front scope guard frame, and a back scope guard frame. An example of the front mount is provided by (and is not limited to) the front bottom slotted mount 106*a*. The front mount is configured to adjustably affix (directly or indirectly) a front rail section of the mounting rail 107 to a front scope section of the scope assembly 104. An example of the back mount is provided by (and is not limited to) the back bottom slotted mount 106*b*. The back mount is configured to adjustably affix (directly or indirectly) the back rail section of the mounting rail 107 to the back scope section of the scope assembly 104. The front mount and the back mount are selectively affixable (directly or indirectly), independently of each other, to the front rail section and the back rail section, respectively, of the mounting rail 107. An example of the front scope guard frame is provided by (and is not limited to) the front side scope guard frame 102*a*. The front scope guard frame is configured to selectively affix (directly or indirectly) with the front mount. The front scope guard frame is also configured to guard, at least in part, the front scope section of the scope assembly 104 once the front scope guard frame is affixed (directly or indirectly) to the front mount. An example of the back scope guard frame is provided by (and is not limited to) the back side scope guard frame 102*b*. The back scope guard frame is configured to selectively affix (directly or indirectly) with the back mount. The back scope guard frame is also configured to guard, at least in part, the back scope section of the scope assembly 104 once the back scope guard frame is affixed (directly or indirectly) to the back mount. The front scope guard frame and the back scope guard frame are selectively positionable and movable, independently of each other, relative to the front mount and the back mount. The front scope guard frame and the back scope guard frame are configured to selectively affix (directly or indirectly), independently of each other, to the mount once the front scope guard frame and the back scope guard frame are positioned just so. A technical effect of the above arrangement is that the apparatus may be more easily custom fitted to a variety of lengths of a variety of the scope assembly 104. In this manner, the cost of manufacturing is reduced for the apparatus to be used or deployed with the wide variety of the scope assembly 104.

In accordance with a specific embodiment (or option), the apparatus is adapted in such a way that the front mount and the back mount are selectively positionable and movable, independently of each other, relative to the front rail section and the back rail section, respectively, of the mounting rail 107. The front mount and the back mount are configured to selectively affix (directly or indirectly), independently of each other, to the front rail section and the back rail section, respectively, of the mounting rail 107 once the front mount and the back mount are positioned just so.

In accordance with a specific embodiment (or option), the apparatus is adapted in such a way that the front scope guard frame and the back scope guard frame are selectively positionable and movable, independently of each other, relative to the front mount and the back mount, respectively.

The front scope guard frame and the back scope guard frame are configured to selectively affix (directly or indirectly), independently of each other, to the front mount and the back mount, respectively once the front scope guard frame and the back scope guard frame are positioned just so.

In accordance with yet another general embodiment (in view of the above description), an apparatus is provided for the scope assembly 104 having a front scope section and a back scope section. The apparatus is also provided for the firearm 108 including the mounting rail 107. The mounting rail 107 has a front rail section and a back rail section. The apparatus includes (and is not limited to) a combination of a front bottom slotted mount 106*a*, a front side scope guard frame 102*a*, and a back bottom slotted mount 106*b*. The front bottom slotted mount 106*a* is configured to adjustably affix to (directly or indirectly) the front rail section of the mounting rail 107. The front bottom slotted mount 106*a* includes (and is not limited to) a front top clamp 105*a* configured to affix (directly or indirectly) the front bottom slotted mount 106*a* to a front scope section of the scope assembly 104. The front side scope guard frame 102*a* has a front inner arm extension 101*a* configured to selectively affix to (directly or indirectly) the front bottom slotted mount 106*a*. The front side scope guard frame 102*a* is configured to guard, at least in part, the front scope section of the scope assembly 104 once (A) the front bottom slotted mount 106*a* is affixed (directly or indirectly) to the front rail section of the mounting rail 107, (B) the front top clamp 105*a* is affixing (directly or indirectly) the front bottom slotted mount 106*a* to the front scope section of the scope assembly 104, and (C) the front side scope guard frame 102*a* having the front inner arm extension 101*a* is affixed (directly or indirectly) to the front bottom slotted mount 106*a*. The back bottom slotted mount 106*b* is configured to adjustably affix (directly or indirectly) to the back rail section (a back rail portion) of the mounting rail 107. The back bottom slotted mount 106*b* includes (and is not limited to) a back top clamp 105*b* configured to affix (directly or indirectly) the back bottom slotted mount 106*b* to a back scope section of the scope assembly 104. The back side scope guard frame 102*b* has a back inner arm extension 101*b*. The back inner arm extension 101*b* is configured to selectively affix to (directly or indirectly) the back bottom slotted mount 106*b*. The back side scope guard frame 102*b* is configured to guard, at least in part, the back scope section of the scope assembly 104 once (A) the back bottom slotted mount 106*b* is affixed to (directly or indirectly) the back rail portion of the mounting rail 107, (B) the back top clamp 105*b* is affixing (directly or indirectly) the back bottom slotted mount 106*b* to the back scope section of the scope assembly 104, and (C) the back side scope guard frame 102*b* having the back inner arm extension 101*b* is affixed to (directly or indirectly) the back bottom slotted mount 106*b*. A technical effect of the apparatus is that the apparatus may be more easily custom fitted to a relatively wider variety of lengths of a variety of scopes (thereby reducing the cost of the manufacturing of the apparatus).

In accordance with a specific embodiment (or option), the apparatus is adapted in such a way that the front bottom slotted mount 106*a* is configured to be selectively affixed to (directly or indirectly) a predetermined front length of the front scope section of the scope assembly 104. The back bottom slotted mount 106*b* is configured to be selectively affixed to (directly or indirectly) a predetermined back length of the back scope section of the scope assembly 104. The front bottom slotted mount 106*a* and the back bottom slotted mount 106*b* are disconnected from each other in such a way that the front bottom slotted mount 106*a* and the back bottom slotted mount 106*b* are affixable (directly or indirectly), independently of each other, to the front rail section (front rail portion) and the back rail section, respectively, of the mounting rail 107.

In accordance with a specific embodiment (or option), the apparatus is adapted in such a way that the front side scope guard frame 102*a* is configured to be positionable along a predetermined front length of the front scope section of the scope assembly 104 before the front side scope guard frame 102*a* is affixed to (directly or indirectly) the front bottom slotted mount 106*a*. The back side scope guard frame 102*b* is configured to be positionable along a predetermined back length of the back scope section of the scope assembly 104 before the front side scope guard frame 102*a* is affixed to (directly or indirectly) the back bottom slotted mount 106*b*. The front side scope guard frame 102*a* and the back side scope guard frame 102*b* are disconnected from each other in such a way that the front side scope guard frame 102*a* and the back side scope guard frame 102*b* are affixable (directly or indirectly), independently of each other, to the front bottom slotted mount 106*a* and the back bottom slotted mount 106*b*, respectively.

In accordance with a specific embodiment (or option), the apparatus is adapted in such a way that the front bottom slotted mount 106*a* is configured to cradle, at least in part, an outer surface of the scope assembly 104 (the front bottom slotted mount 106*a* provides a front scope cradle 118*a*). The back bottom slotted mount 106*b* is configured to cradle, at least in part, an outer surface of the back scope section (back scope portion) of the scope assembly 104 (the back bottom slotted mount 106*b* provides a cradle that is similar to the front scope cradle 118*a*).

In accordance with a specific embodiment (or option), the apparatus is adapted in such a way that the front bottom slotted mount 106*a* is configured to contact, at least in part, an outer surface of the front scope section of the scope assembly 104. The back bottom slotted mount 106*b* is configured to contact, at least in part, an outer surface of the back scope section of the scope assembly 104.

In accordance with a specific embodiment (or option), the apparatus is adapted in such a way that the front side scope guard frame 102*a* is configured to disconnect from the front bottom slotted mount 106*a*, to positionally readjust relative to the front scope section of the scope assembly 104, and to reaffix to (directly or indirectly) the front bottom slotted mount 106*a*. The back side scope guard frame 102*b* is configured to disconnect from the back bottom slotted mount 106*b*, to positionally readjust relative to the back scope section of the scope assembly 104, and to reaffix to (directly or indirectly) the back bottom slotted mount 106*b*. A technical effect of this option is that the front side scope guard frame 102*a* and the back side scope guard frame 102*b* are positionally adjustable to accommodate control features (knobs) of the scope assembly 104. In this manner, the front side scope guard frame 102*a* and the back side scope guard frame 102*b* may be used or deployed with a relatively wide range of types and models of the scope assembly 104 that may be manufactured by different manufacturers.

In accordance with a specific embodiment (or option), the apparatus is adapted in such a way that the front side scope guard frame 102*a* and the back side scope guard frame 102*b* once so adjustably mounted to the front bottom slotted mount 106*a* and to the back bottom slotted mount 106*b*, respectively, are positioned relative to the scope assembly 104 in such a way to accommodate operative user access to the focus adjustment of the scope assembly 104.

In accordance with a specific embodiment (or option), the apparatus is adapted in such a way that the front side scope guard frame 102*a* and the back side scope guard frame 102*b* each includes a rounded cross-sectional rigid bar configured to be positioned along, at least in part, lateral sides of the scope assembly 104 once the front side scope guard frame 102*a* is operatively affixed to (directly or indirectly) the front bottom slotted mount 106*a* and the back side scope guard frame 102*b* is operatively affixed to (directly or indirectly) the back bottom slotted mount 106*b*.

In accordance with a specific embodiment (or option), the apparatus is adapted in such a way that the front side scope guard frame 102*a* and the back side scope guard frame 102*b* each includes a cross-sectional rigid bar that is, at least in part, straight, and is configured to be positioned along, at least in part, opposite lateral sides of the scope assembly 104 once the front side scope guard frame 102*a* is operatively affixed to (directly or indirectly) the front bottom slotted mount 106*a*, and once the back side scope guard frame 102*b* is operatively affixed to (directly or indirectly) the back bottom slotted mount 106*b*.

In accordance with a specific embodiment (or option), the apparatus is adapted in such a way that the front side scope guard frame 102*a* includes a first front top scope guard frame 103*a* extending from a front distal end of the front side scope guard frame 102*a*. The first front top scope guard frame 103*a* is configured to guard, at least in part, the front distal end of the front scope section of the scope assembly 104.

In accordance with a specific embodiment (or option), the apparatus is adapted in such a way that the back side scope guard frame 102*b* includes a first back top scope guard frame 103*b* extending from a back distal end of the back side scope guard frame 102*b*. The first back top scope guard frame 103*b* is configured to guard, at least in part, the back distal end of the back scope section of the scope assembly 104.

In accordance with a specific embodiment (or option), the apparatus is adapted in such a way that the first front top scope guard frame 103*a* and the first back top scope guard frame 103*b* each includes a cross-sectional rigid bar that is, at least in part, curved.

In accordance with a specific embodiment (or option), the apparatus is adapted in such a way that the front side scope guard frame 102*a* further includes a second front top scope guard frame 110*a* extending from a front distal end of the front side scope guard frame 102*a*. The second front top scope guard frame 110*a* is spaced apart from the first front top scope guard frame 103*a*. The second front top scope guard frame 110*a* is configured to guard, at least in part, a front top section of the scope assembly 104.

In accordance with a specific embodiment (or option), the apparatus is adapted in such a way that the back side scope guard frame 102*b* further includes a second back top scope guard frame 110*b* extending from a back distal end of the back side scope guard frame 102*b*. The second back top scope guard frame 110*b* is spaced apart from the first back top scope guard frame 103*b*. The second back top scope guard frame 110*b* is configured to guard, at least in part, a front top section of the scope assembly 104.

In accordance with a specific embodiment (or option), the apparatus is adapted in such a way that the second front top scope guard frame 110*a* and the second back top scope guard frame 110*b* each includes a cross-sectional rigid bar that is, at least in part, curved (semi-circular ring shape).

In accordance with a specific embodiment (or option), the apparatus is adapted in such a way that the front side scope guard frame 102*a*, the back side scope guard frame 102*b*, the first front top scope guard frame 103*a*, the first back top scope guard frame 103*b*, the second front top scope guard frame 110*a* and the second back top scope guard frame 110*b* are positioned and affixed in such a way that user access to the controls of the scope assembly 104 is permitted without adjusting the position of the front side scope guard frame 102*a*, the back side scope guard frame 102*b*, the first front top scope guard frame 103*a*, the first back top scope guard frame 103*b*, the second front top scope guard frame 110*a* and the second back top scope guard frame 110*b*.

In accordance with a specific embodiment (or option), the apparatus is adapted in such a way that the front side scope guard frame 102*a* and the back side scope guard frame 102*b* are sized to extend a length of the scope assembly (104) once positioned and affixed to do just so.

In accordance with a specific embodiment (or option), the apparatus is adapted in such a way that the first front top scope guard frame 103*a* and the first back top scope guard frame 103*b* are sized to extend a width of the scope assembly (104) once positioned and affixed to do just so.

In accordance with a specific embodiment (or option), the apparatus is adapted in such a way that the outer guard 134 is provided and is configured to affix to the front side scope guard frame 102*a*, and is also configured to cover, at least in part, the scope assembly 104 once affixed to do just so without obstructing access to a power ring zoom adjuster 135 of the scope assembly 104.

In accordance with a specific embodiment (or option), the apparatus is adapted in such a way that the guard section 130 is provided and is configured to be selectively affixed to, and span (spanned) between, at least in part, the front top clamp 105*a* and the back top clamp 105*b*, and the guard section 130 is configured to selectively protectively cover, at least in part, elevation controls of the scope assembly 104 (such as, parallax and windage adjustments 132) once the guard section 130 is affixed to do just so.

In accordance with a specific embodiment (or option), the apparatus is adapted in such a way that the front bottom slotted mount 106*a* includes: (A) a front mount rail clamp 115*a* configured to affix the front bottom slotted mount 106*a* to the front rail section of the mounting rail 107, and (B) the back bottom slotted mount 106*b* includes a back mount rail clamp 115*b* configured to affix the back bottom slotted mount 106*b* to the back rail section of the mounting rail 107.

In accordance with a major embodiment, there is provided an apparatus is for the scope assembly 104 having a front scope section and a back scope section, and a firearm 108 including a mounting rail 107 having a front rail section and a back rail section. The apparatus includes (and is not limited to) a front scope guard frame (such as, and not limited to, the front side scope guard frame 102*a*) configured to be affixed at a front stationary position relative to the mounting rail 107 of the firearm 108. The front scope guard frame is also configured to guard, at least in part, the front scope section of the scope assembly. The apparatus also includes a back scope guard frame (such as, and not limited to, the back side scope guard frame 102*b*) configured to be affixed at a back stationary position relative to the mounting rail 107 of the firearm 108. The back scope guard frame is also configured to guard, at least in part, the back scope section of the scope assembly. The front scope guard frame and the back scope guard frame are selectively positionable and movable, independently of each other at the front stationary position and the back stationary position, respectively. The front scope guard frame and the back scope guard frame are configured to be selectively affixed, independently of each other, at the front stationary position and the back stationary position, respectively, relative to the mounting rail of the firearm once the front scope guard frame and the back scope guard frame are positioned just so. It will be appreciated that the front scope guard frame and the back scope guard frame may be mountable (directly or indirectly) to the front section and the back section (respectively, of the mounting rail 107 (if so desired). It will be appreciated that the front scope guard frame and the back scope guard frame may be mountable (directly or indirectly) to any part of the mounting rail 107 (if so desired). It will be appreciated that the front scope guard frame and the back scope guard frame may be mountable (directly or indirectly) to the firearm 108 (if so desired). It will be appreciated that the front scope guard frame and the back scope guard frame may be mountable (directly or indirectly) to the scope assembly 104 (if so desired).

In accordance with a major embodiment, there is provided an apparatus. The apparatus includes (and is not limited to) the scope assembly 104 having a front scope section and a back scope section. The apparatus also includes a firearm including a mounting rail having a front rail section and a back rail section. The apparatus also includes a front scope guard frame (such as, and not limited to, the front side scope guard frame 102*a*) configured to be affixed at a front stationary position relative to the mounting rail of the firearm. The front scope guard frame is also configured to guard, at least in part, the front scope section of the scope assembly. The apparatus also includes a back scope guard frame (such as, and not limited to the back side scope guard frame 102*b*) configured to be affixed at a back stationary position relative to the mounting rail of the firearm. The back scope guard frame is also configured to guard, at least in part, the back scope section of the scope assembly. The front scope guard frame and the back scope guard frame are selectively positionable and movable, independently of each other at the front stationary position and the back stationary position, respectively. The front scope guard frame and the back scope guard frame are configured to be selectively affixed, independently of each other, at the front stationary position and the back stationary position, respectively, relative to the mounting rail of the firearm once the front scope guard frame and the back scope guard frame are positioned just so. It will be appreciated that the front scope guard frame and the back scope guard frame may be mountable (directly or indirectly) to the front section and the back section (respectively, of the mounting rail 107 (if so desired). It will be appreciated that the front scope guard frame and the back scope guard frame may be mountable (directly or indirectly) to any part of the mounting rail 107 (if so desired). It will be appreciated that the front scope guard frame and the back scope guard frame may be mountable (directly or indirectly) to the firearm 108 (if so desired). It will be appreciated that the front scope guard frame and the back scope guard frame may be mountable (directly or indirectly) to the scope assembly 104 (if so desired).

It will be appreciated that any description directed to describing, and/or any FIG. directed to depicting, the components used in the front section of the assembly (such as, the front inner arm extension 101*a*, the front side scope guard frame 102*a*, the first front top scope guard frame 103*a*, the front top clamp 105*a*, the front bottom slotted mount 106*a*, the second front top scope guard frame 110*a*, the front mount rail clamp 115*a*, the front scope cradle 118*a* and the front side protruding scope guard arm 119*a*) are equally applicable to the back section of the assembly.

It will be appreciated that any description directed to describing, and/or any FIG. directed to depicting, the components used in the front section of the assembly (such as, the back inner arm extension 101*b*, the back side scope guard frame 102*b*, the first back top scope guard frame 103*b*, the back top clamp 105*b*, the back bottom slotted mount 106*b*, the second back top scope guard frame 110*b*, the back mount rail clamp 115*b* and the back side protruding scope guard arm 119*b*) are equally applicable to the front section of the assembly.

It will be appreciated that the front side scope guard frame 102*a*, the first front top scope guard frame 103*a* and the front side protruding scope guard arm 119*a* are configured to protect, at least in part, the elevation adjustment 131. It will be appreciated that the back side scope guard frame 102*b*, the first back top scope guard frame 103*b* and the back side protruding scope guard arm 119*b* are configured to protect, at least in part, the elevation adjustment 131.

It will be appreciated that the front scope guard frame and the back scope guard frame may be mountable (directly or indirectly) to the front section and the back section (respectively, of the mounting rail 107 (if so desired). It will be appreciated that the front scope guard frame and the back scope guard frame may be mountable (directly or indirectly) to any part of the mounting rail 107 (if so desired). It will be appreciated that the front scope guard frame and the back scope guard frame may be mountable (directly or indirectly) to the firearm 108 (if so desired). It will be appreciated that the front scope guard frame and the back scope guard frame may be mountable (directly or indirectly) to the scope assembly 104 (if so desired).

This written description uses examples to disclose the embodiments, including the best mode. The written description also enables any person skilled in the art to make and use the embodiments. The patentable scope of the invention is defined by the claims, and may include other examples that occur to those skilled in the art. Such other examples are within the scope of the claims if they have structural elements that do not differ from the literal language of the claims, or if they include equivalent structural elements with insubstantial differences from the literal language of the claims.

It may be appreciated that the assemblies and modules described above may be connected with each other as required to perform desired functions and tasks within the scope of persons of skill in the art to make such combinations and permutations without having to describe each and every one in explicit terms. There is no particular assembly, or component that may be superior to any of the equivalents available to the person skilled in art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus for a scope assembly having a front scope section and a back scope section, and a firearm including a mounting rail having a front rail section and a back rail section, the apparatus comprising:

a mount being configured to selectively affix the mounting rail to the scope assembly;

a front scope guard frame being configured to guard, at least in part, the front scope section of the scope assembly; and a back scope guard frame being configured to guard, at least in part, the back scope section of the scope assembly;

the front scope guard frame and the back scope guard frame being selectively positionable and movable, independently of each other, relative to the mount; and the front scope guard frame and the back scope guard frame being configured to selectively affix, independently of each other, to the mount once the front scope guard frame and the back scope guard frame are positioned in relation to each other.

2. The apparatus of claim 1, wherein:

the mount includes:

a front mount;

a back mount, the front mount and the back mount being configured to receive and to support the scope assembly;

the front mount and the back mount each being selectively positionable and movable, independently of each other, relative to the front rail section and the back rail section, respectively, of the mounting rail; and the front mount and the back mount each being configured to selectively affix, independently of each other, to the front rail section and the back rail section, respectively, of the mounting rail once the front mount and the back mount are positioned in relation to each other.

3. The apparatus of claim 2, wherein:

the front scope guard frame and the back scope guard frame being selectively positionable and movable, independently of each other, relative to the front mount and the back mount, respectively, and the front scope guard frame and the back scope guard frame being configured to selectively affix, independently of each other, to the front mount and the back mount, respectively once the front scope guard frame and the back scope guard frame are positioned in relation to each other.

4. The apparatus of claim 1, wherein:

the mount is configured to cradle, at least in part, an outer surface of the scope assembly.

5. The apparatus of claim 1, wherein:

the front scope guard frame and the back scope guard frame each includes:

a rounded cross-sectional rigid bar being configured to be positioned along, at least in part, lateral sides of the scope assembly once the front scope guard frame and the back scope guard frame are affixed to the mount.

6. The apparatus of claim 1, wherein:

the front scope guard frame includes:

a front side scope guard frame extending along front lateral sides of the scope assembly; and a first front top scope guard frame extending from a front distal end of the front side scope guard frame; and the first front top scope guard frame being configured to guard, at least in part, the front distal end of the front scope section of the scope assembly;

the back scope guard frame includes:

a back side scope guard frame extending along back lateral sides of the scope assembly; and a first back top scope guard frame extending from a back distal end of the back side scope guard frame; and the first back top scope guard frame being configured to guard, at least in part, the back distal end of the back scope section of the scope assembly.

7. The apparatus of claim 6, wherein:

the front scope guard frame includes:

a second front top scope guard frame extending from the front distal end of the front side scope guard frame; and the second front top scope guard frame being spaced apart from the first front top scope guard frame; and the second front top scope guard frame being configured to guard, at least in part, a front top section of the scope assembly; and the back scope guard frame includes:

a second back top scope guard frame extending from the back distal end of the back side scope guard frame; and the second back top scope guard frame being spaced apart from the first back top scope guard frame; and the second back top scope guard frame being configured to guard, at least in part, a back top section of the scope assembly.

8. The apparatus of claim 1, further comprising:

an outer guard being configured to connect to any one of the front scope guard frame and the back scope guard frame, and also being configured to protectively cover, at least in part, the top and sides of the scope assembly.

9. The apparatus of claim 1, further comprising:

a guard section being configured to be selectively affixed to, and span between, the front scope guard frame and the back scope guard frame.

10. An apparatus for a scope assembly having a front scope section and a back scope section, and a firearm including a mounting rail having a front rail section and a back rail section, the apparatus comprising:

a front mount being configured to adjustably affix the front rail section of the mounting rail to the front scope section of the scope assembly;

a back mount being configured to adjustably affix the back rail section of the mounting rail to the back scope section of the scope assembly;

the front mount and the back mount each being selectively affixable, independently of each other, to the front rail section and the back rail section, respectively, of the mounting rail;

a front scope guard frame being configured to selectively affix with the front mount, and the front scope guard frame also being configured to guard, at least in part, the front scope section of the scope assembly once the front scope guard frame is affixed to the front mount; and a back scope guard frame being configured to selectively affix with the back mount, and the back scope guard frame also being configured to guard, at least in part, the back scope section of the scope assembly once the back scope guard frame is affixed to the back mount;

the front scope guard frame and the back scope guard frame being selectively positionable and movable, independently of each other, relative to the front mount and the back mount; and the front scope guard frame and the back scope guard frame being configured to selectively affix, independently of each other, to the front mount and the back mount once the front scope guard frame and the back scope guard frame are positioned in relation to each other.

11. The apparatus of claim 10, wherein:

the front mount and the back mount each being selectively positionable and movable, independently of each other, relative to the front rail section and the back rail section, respectively, of the mounting rail; and the front mount and the back mount being configured to selectively affix, independently of each other, to the front rail section and the back rail section, respectively, of the mounting rail once the front mount and the back mount are positioned in relation to each other.

12. The apparatus of claim 11, wherein:

the front scope guard frame and the back scope guard frame being selectively positionable and movable, independently of each other, relative to the front mount and the back mount, respectively, and the front scope guard frame and the back scope guard frame being configured to selectively affix, independently of each other, to the front mount and the back mount, respectively once the front scope guard frame and the back scope guard frame are positioned in relation to each other.

13. An apparatus for a scope assembly having a front scope section and a back scope section, and a firearm including a mounting rail having a front rail section and a back rail section, the apparatus comprising:

a front bottom slotted mount being configured to adjustably affix to the front rail section of the mounting rail; and the front bottom slotted mount including:

a front top clamp being configured to affix the front bottom slotted mount to the front scope section of the scope assembly; and a front side scope guard frame having a front inner arm extension being configured to selectively affix to the front bottom slotted mount; and the front side scope guard frame being configured to guard, at least in part, the front scope section of the scope assembly once the front bottom slotted mount is affixed to the front rail section of the mounting rail; the front top clamp is affixing the front bottom slotted mount to the front scope section of the scope assembly, and the front side scope guard frame having the front inner arm extension is affixed to the front bottom slotted mount;

a back bottom slotted mount being configured to adjustably affix to the back rail section of the mounting rail; and the back bottom slotted mount including:

a back top clamp being configured to affix the back bottom slotted mount to the back scope section of the scope assembly; and a back side scope guard frame having a back inner arm extension being configured to selectively affix to the back bottom slotted mount; and the back side scope guard frame being configured to guard, at least in part, the back scope section of the scope assembly once the back bottom slotted mount is affixed to the back rail section of the mounting rail; the back top clamp is affixing the back bottom slotted mount to the back scope section of the scope assembly, and the back side scope guard frame having the back inner arm extension is affixed to the back bottom slotted mount.

14. The apparatus of claim 13, wherein:

the front bottom slotted mount is configured to be selectively affixed to a predetermined front length of the front scope section of the scope assembly;

the back bottom slotted mount is configured to be selectively affixed to a predetermined back length of the back scope section of the scope assembly; and the front bottom slotted mount and the back bottom slotted mount are disconnected from each other in such a way that the front bottom slotted mount and the back bottom slotted mount are affixable, independently of each other, to the front rail section and the back rail section, respectively, of the mounting rail.

15. The apparatus of claim 14, wherein:

the front side scope guard frame is configured to be positionable along the predetermined front length of the front scope section of the scope assembly before the front side scope guard frame is affixed to the front bottom slotted mount;

the back side scope guard frame is configured to be positionable along the predetermined back length of the back scope section of the scope assembly before the front side scope guard frame is affixed to the back bottom slotted mount; and the front side scope guard frame and the back side scope guard frame are disconnected from each other in such a way that the front side scope guard frame and the back side scope guard frame are affixable, independently of each other, to the front bottom slotted mount and the back bottom slotted mount; respectively.

16. The apparatus of claim 14, wherein:

the front bottom slotted mount is configured to cradle, at least in part, a front outer surface of the scope assembly; and the back bottom slotted mount is configured to cradle, at least in part, a back outer surface of the back scope section of the scope assembly.

17. The apparatus of claim 14, wherein:

the front bottom slotted mount is configured to contact, at least in part, a front outer surface of the front scope section of the scope assembly; and the back bottom slotted mount is configured to contact, at least in part, a back outer surface of the back scope section of the scope assembly.

18. The apparatus of claim 14, wherein:

the front side scope guard frame is configured to disconnect from the front bottom slotted mount; to positionally readjust relative to the front scope section of the scope assembly; and to reaffix to the front bottom slotted mount; and the back side scope guard frame is configured to disconnect from the back bottom slotted mount; to positionally readjust relative to the back scope section of the scope assembly; and to reaffix to the back bottom slotted mount.

19. The apparatus of claim 14, wherein:

the front side scope guard frame and the back side scope guard frame once so adjustably mounted to the front bottom slotted mount and to the back bottom slotted mount; respectively, are positioned relative to the scope assembly in such a way to accommodate operative user access to a focus adjustment of the scope assembly.

20. An apparatus for a scope assembly having a front scope section and a back scope section, and a firearm including a mounting rail having a front rail section and a back rail section, the apparatus comprising:

a front scope guard frame being configured to be affixed at a front stationary position relative to the mounting rail of the firearm, and also being configured to guard, at least in part, the front scope section of the scope assembly; and a back scope guard frame being configured to be affixed at a back stationary position relative to the mounting rail of the firearm, and also being configured to guard, at least in part, the back scope section of the scope assembly;

the front scope guard frame and the back scope guard frame being selectively positionable and movable, independently of each other at the front stationary position and the back stationary position, respectively; and the front scope guard frame and the back scope guard frame being configured to be selectively affixed, independently of each other, at the front stationary position and the back stationary position, respectively, relative to the mounting rail of the firearm once the front scope guard frame and the back scope guard frame are positioned in relation to each other.

21. An apparatus, comprising:

a scope assembly having a front scope section and a back scope section;

a firearm including a mounting rail having a front rail section and a back rail section;

a front scope guard frame being configured to be affixed at a front stationary position relative to the mounting rail of the firearm, and also being configured to guard, at least in part, the front scope section of the scope assembly; and a back scope guard frame being configured to be affixed at a back stationary position relative to the mounting rail of the firearm, and also being configured to guard, at least in part, the back scope section of the scope assembly;

the front scope guard frame and the back scope guard frame being selectively positionable and movable, independently of each other at the front stationary position and the back stationary position, respectively; and the front scope guard frame and the back scope guard frame being configured to be selectively affixed, independently of each other, at the front stationary position and the back stationary position, respectively, relative to the mounting rail of the firearm once the front scope guard frame and the back scope guard frame are positioned in relation to each other.

* * * * *